US010172489B2

(12) United States Patent
Goldman et al.

(10) Patent No.: US 10,172,489 B2
(45) **Date of Patent: *Jan. 8, 2019**

(54) COLLAPSIBLE HOOK HANGER

(71) Applicant: Uniplast Industries, Inc., Hasbrouck Heights, NJ (US)

(72) Inventors: Stuart Goldman, Wayne, NJ (US); King Keung Kennedy Chan, Pokfulam (HK)

(73) Assignee: UNIPLAST INDUSTRIES, INC., Hasbrouck Heights, NJ (US)

( * ) Notice: Subject to any disclaimer, the term of this patent is extended or adjusted under 35 U.S.C. 154(b) by 16 days.

This patent is subject to a terminal disclaimer.

(21) Appl. No.: 15/411,004

(22) Filed: Jan. 20, 2017

(65) Prior Publication Data

US 2017/0325613 A1 Nov. 16, 2017

Related U.S. Application Data

(63) Continuation-in-part of application No. 15/151,051, filed on May 10, 2016, now Pat. No. 9,820,599.

(51) Int. Cl.
*A47G 25/32* (2006.01)
*A47G 25/40* (2006.01)

(52) U.S. Cl.
CPC ..... *A47G 25/40* (2013.01); *A47G 25/32* (2013.01)

(58) Field of Classification Search
CPC ..... A47G 25/32; A47G 25/38; A47G 25/40
USPC ..... 40/322; 223/89, 94
See application file for complete search history.

(56) References Cited

U.S. PATENT DOCUMENTS 3,467,291 A * 9/1969 Phillips ..... A47G 25/32 223/85
4,063,670 A 12/1977 Faarbech
4,168,791 A * 9/1979 Clark, Jr. ..... A47G 25/50 223/94
5,074,445 A 12/1991 Chen
5,085,357 A * 2/1992 Chen ..... A47G 25/4038 223/85
5,456,391 A * 10/1995 Chang ..... A47G 25/443 223/89
5,826,759 A * 10/1998 Ohsugi ..... A47G 25/32 223/85
5,975,384 A 11/1999 Manabat
6,000,587 A * 12/1999 Sackett ..... A47G 25/32 223/85
6,286,735 B1 9/2001 Zuckerman
(Continued)

*Primary Examiner* — Nathan Durham
(74) *Attorney, Agent, or Firm* — Leason Ellis LLP

(57) ABSTRACT

A collapsible hook hanger includes a hook having a threaded end and a hanger body including a cross bar having a top edge. A hook receiving body extends from the top edge of the cross bar and is defined by a first side wall and an opposing second side wall. An inner surface of the first side wall includes a first recess that is located opposite a second recess formed in the second side wall. The hook receiving body has a hook receiving slot for receiving the hook. An axle member is rotatably disposed within each of the first and second recesses. The axle member includes a threaded bore that receives the threaded end of the hook which is securely coupled to the axle member. The axle member is captured between the first and second side walls while permitting free rotation of the axle member within the hook receiving body.

18 Claims, 23 Drawing Sheets

(56) References Cited

U.S. PATENT DOCUMENTS

| | | | | |
|---|---|---|---|---|
| 7,837,074 | B2 * | 11/2010 | Rude | A47G 25/32 223/85 |
| 7,905,376 | B2 * | 3/2011 | Gouldson | A47G 25/1428 223/85 |
| 8,113,393 | B2 | 2/2012 | Ho | |
| 8,235,261 | B1 * | 8/2012 | Park | A47G 25/4023 223/94 |
| 9,549,630 | B2 | 1/2017 | Hansen | |
| 9,655,466 | B1 * | 5/2017 | Bernstein | A47G 25/1428 |
| 2002/0056735 | A1 * | 5/2002 | Lam | A47G 25/443 223/94 |
| 2006/0054646 | A1 * | 3/2006 | Nathanmanna | A47G 25/4023 223/89 |
| 2008/0283558 | A1 | 11/2008 | Rude | |
| 2009/0283556 | A1 * | 11/2009 | Ho | A47G 25/32 223/85 |
| 2016/0088964 | A1 | 3/2016 | Hansen et al. | |
| 2016/0088965 | A1 * | 3/2016 | Hansen | A47G 25/32 223/85 |

* cited by examiner

COLLAPSIBLE HOOK HANGER

CROSS-REFERENCE TO RELATED APPLICATION

The present application is a continuation-in-part of U.S. patent application Ser. No. 15/151,051, filed May 10, 2016, now U.S. Pat. No. 9,820,599, issued Nov. 21, 2017, which is hereby incorporated by reference in its entirety.

TECHNICAL FIELD

The present invention relates to garment hangers and more particularly, to a garment hanger having a collapsible hook.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of constructions to accommodate different articles that are carried by the hangers.

A traditional type of garment hanger includes a metal hook which is received in and mates to a threaded boss located on the upper frame. More specifically, one end of the metal hook is a threaded end that mates with the threaded boss. The body of the hanger is typically made of plastic.

Many times, garments that are manufactured overseas are pre-hung on a hanger and then shipped to another country as a garment/hanger combination. Upon delivery to the final retail location, the garment is simply removed from the box (packaging) and hung in the retail location. Since shipping and transportation costs are not insignificant, it is desirable to pack the garments as tight as possible in the packaging boxes/containers. However, the hooks of the garment hangers take up a significant volume of space within the packaging boxes/containers. This additional space, of course, translates into additional shipping costs.

There is therefore a need for a garment hanger that operates as a conventional hanger but is also capable of providing a reduced footprint during packaging/transportation.

SUMMARY

A collapsible hook hanger includes a hook having a threaded end and a hanger body including a cross bar having a top edge. A hook receiving body extends from the top edge of the cross bar and is defined by a first side wall and an opposing second side wall. An inner surface of the first side wall includes a first recess that is located opposite a second recess formed in the second side wall. The hook receiving body has a hook receiving slot for receiving the hook. An axle member is rotatably disposed within each of the first and second recesses. The axle member includes a threaded bore that receives the threaded end of the hook which is securely coupled to the axle member. The axle member is captured between the first and second side walls while permitting free rotation of the axle member within the hook receiving body.

BRIEF DESCRIPTION OF THE DRAWING FIGURES

Figure 10A:
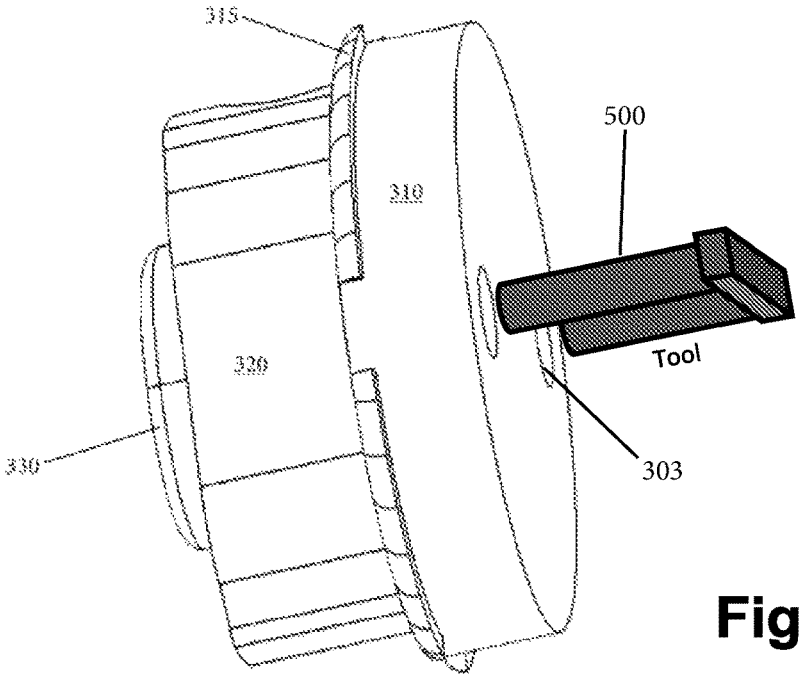
Figure 10B:
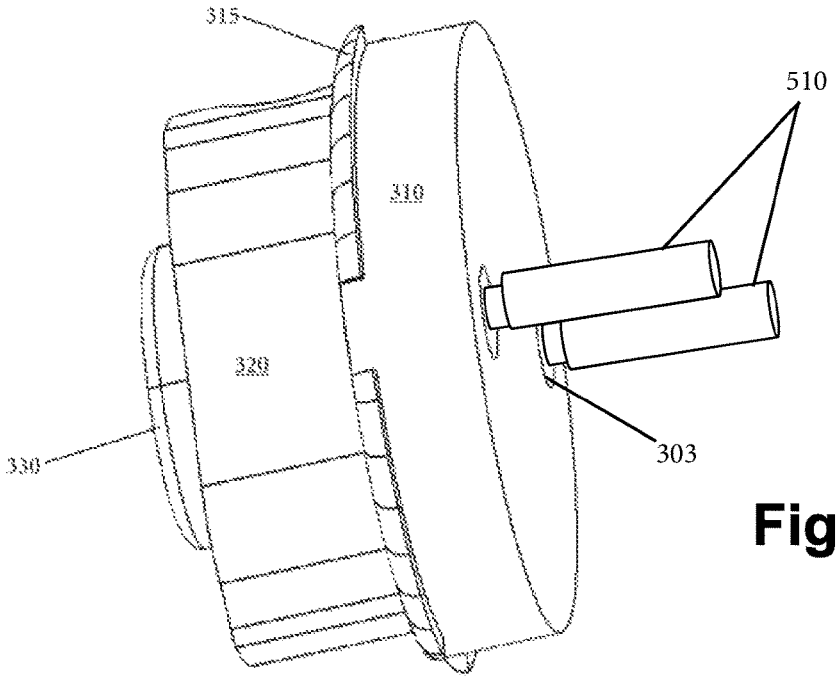
Figure 10C:
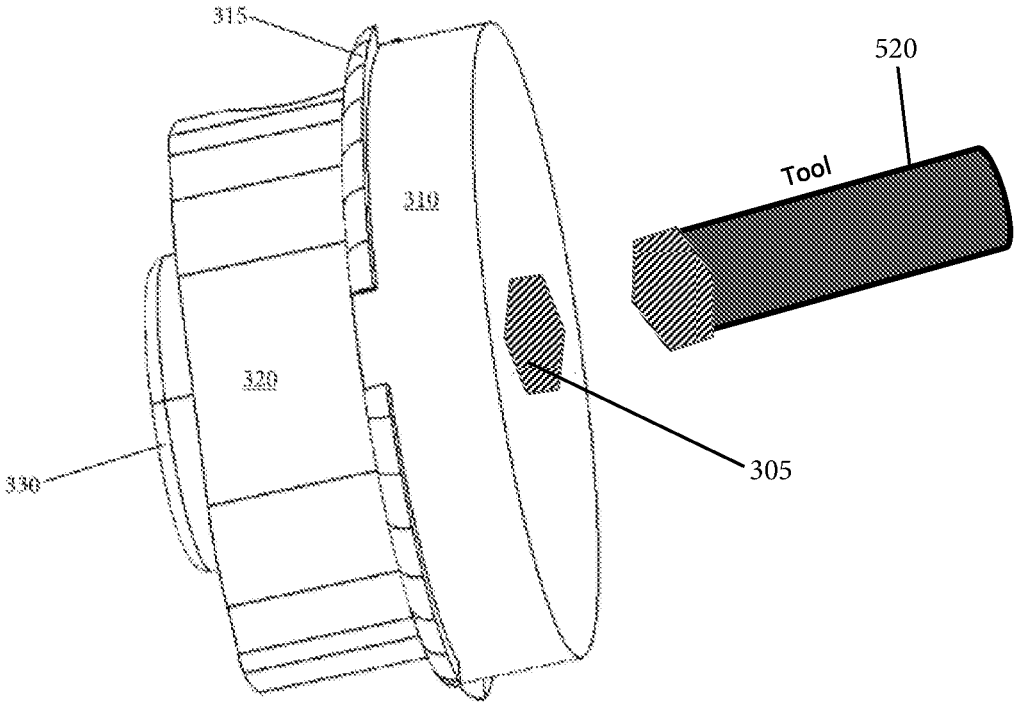
Figure 11:
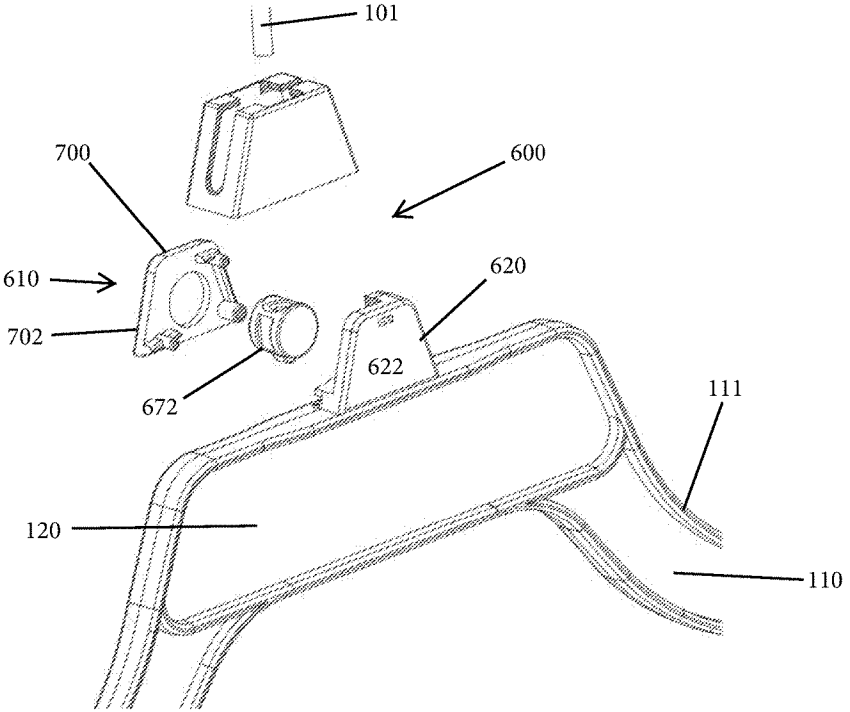
Figure 12:
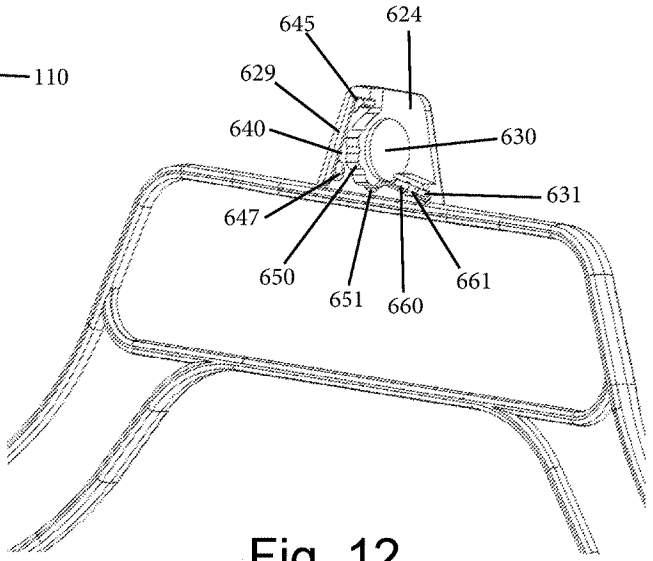
Figure 13:
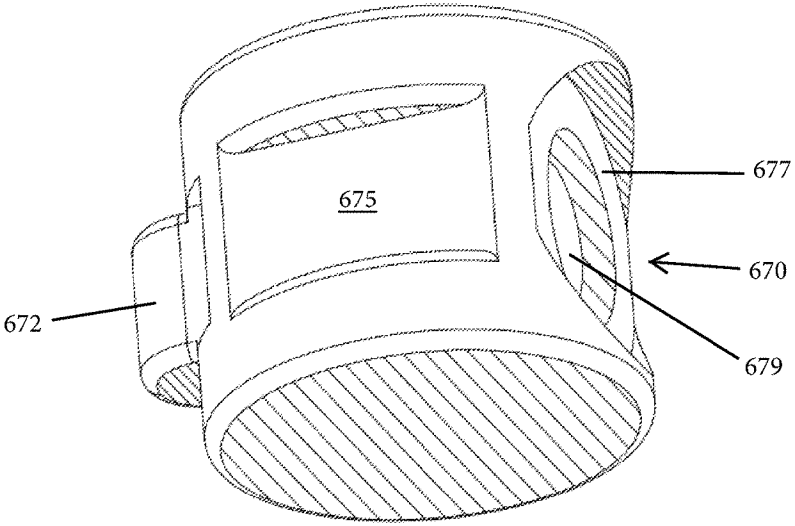
Figure 14:
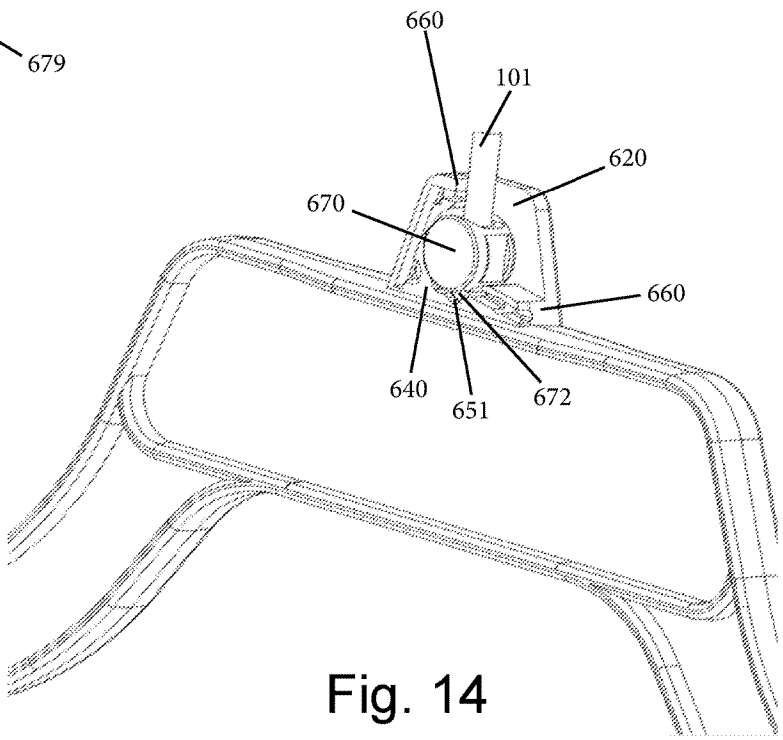
Figure 15:
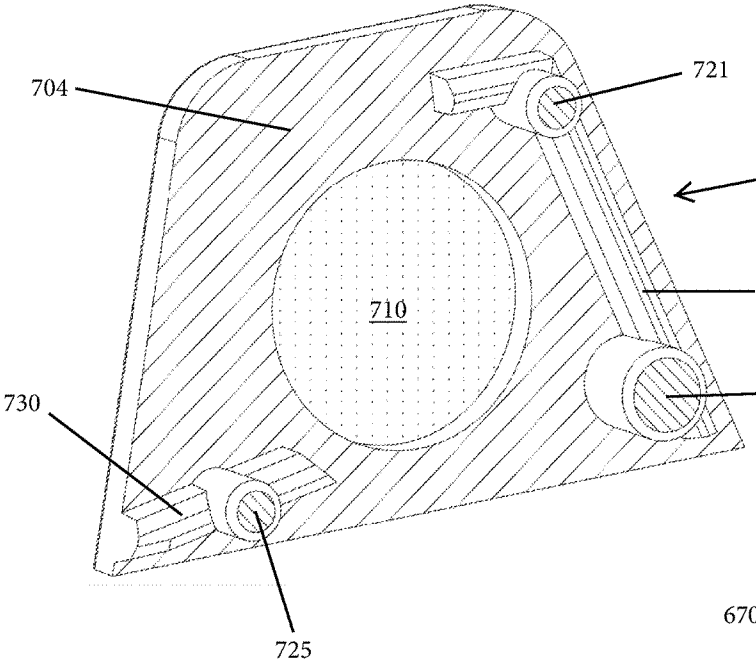
Figure 16:
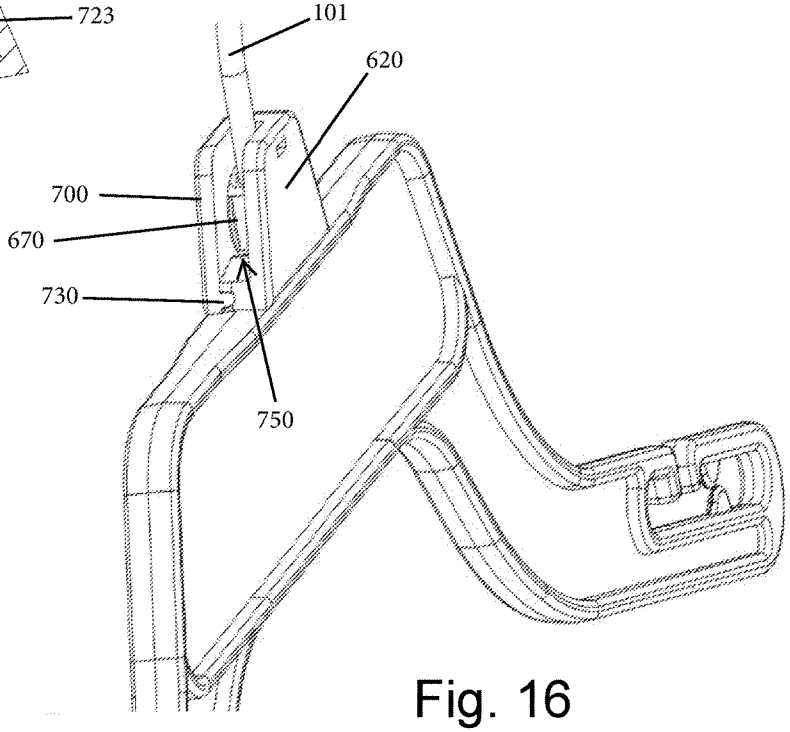
Figure 18:
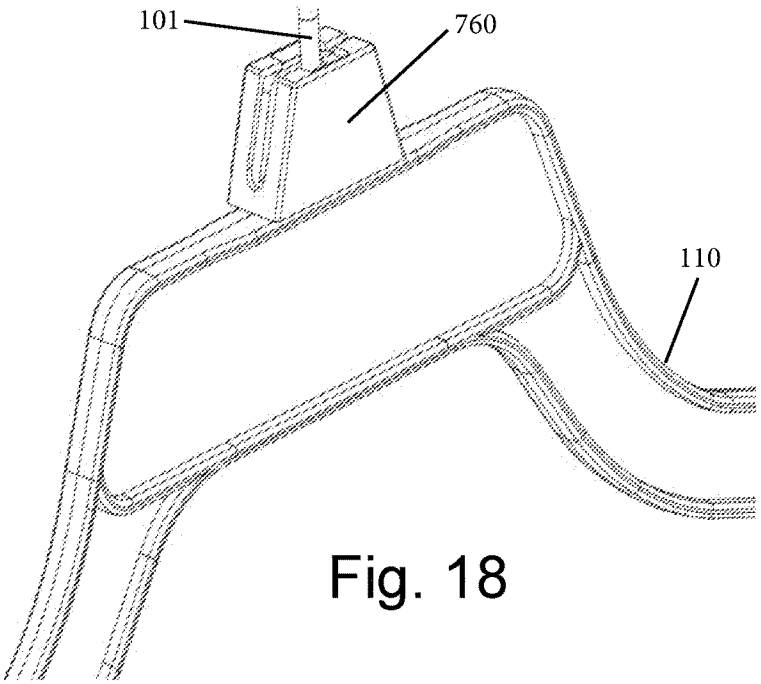
Figure 17:
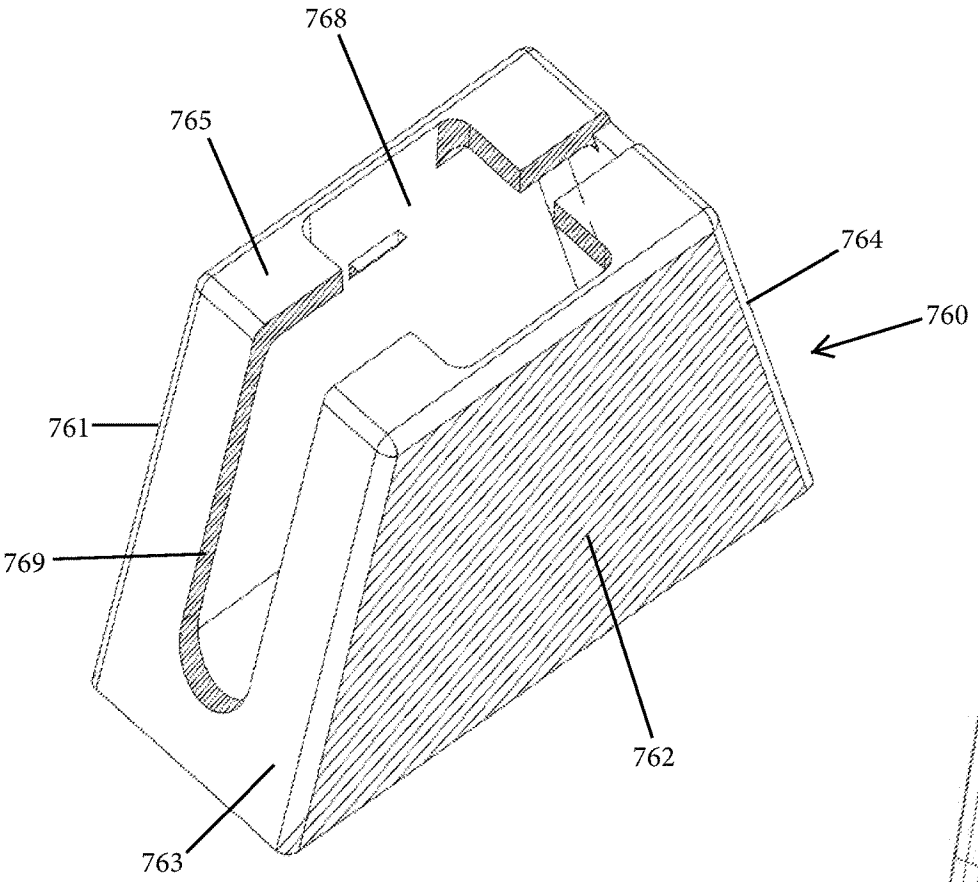
Figure 19A:
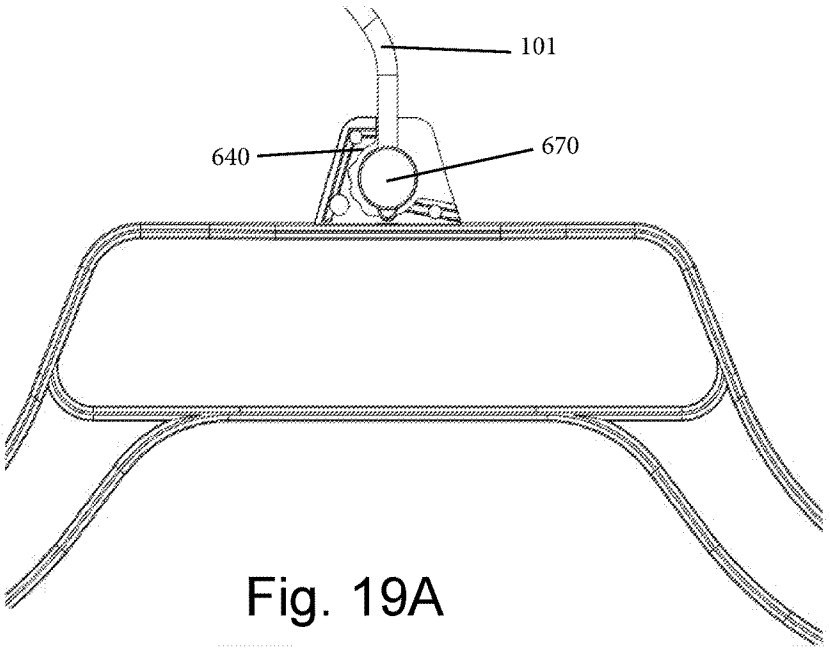
Figure 19B:
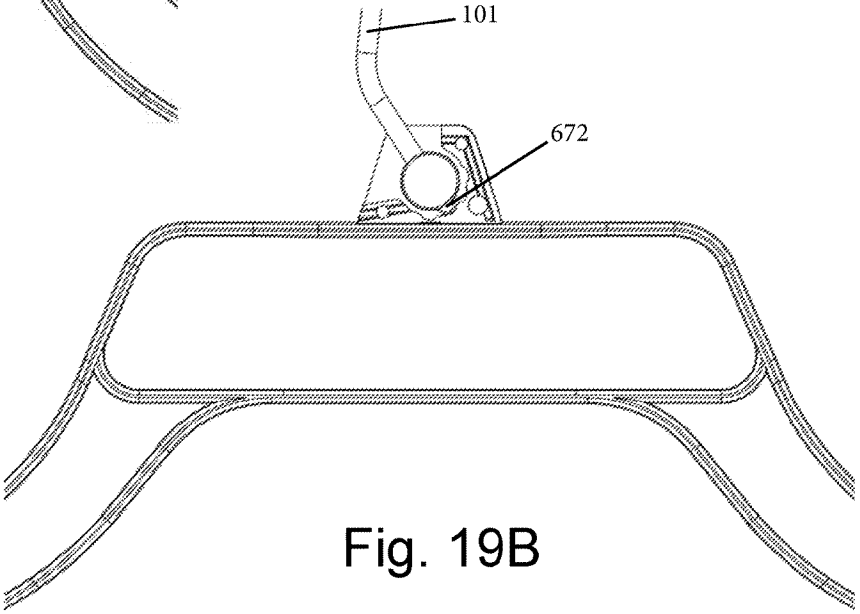
Figure 19C:
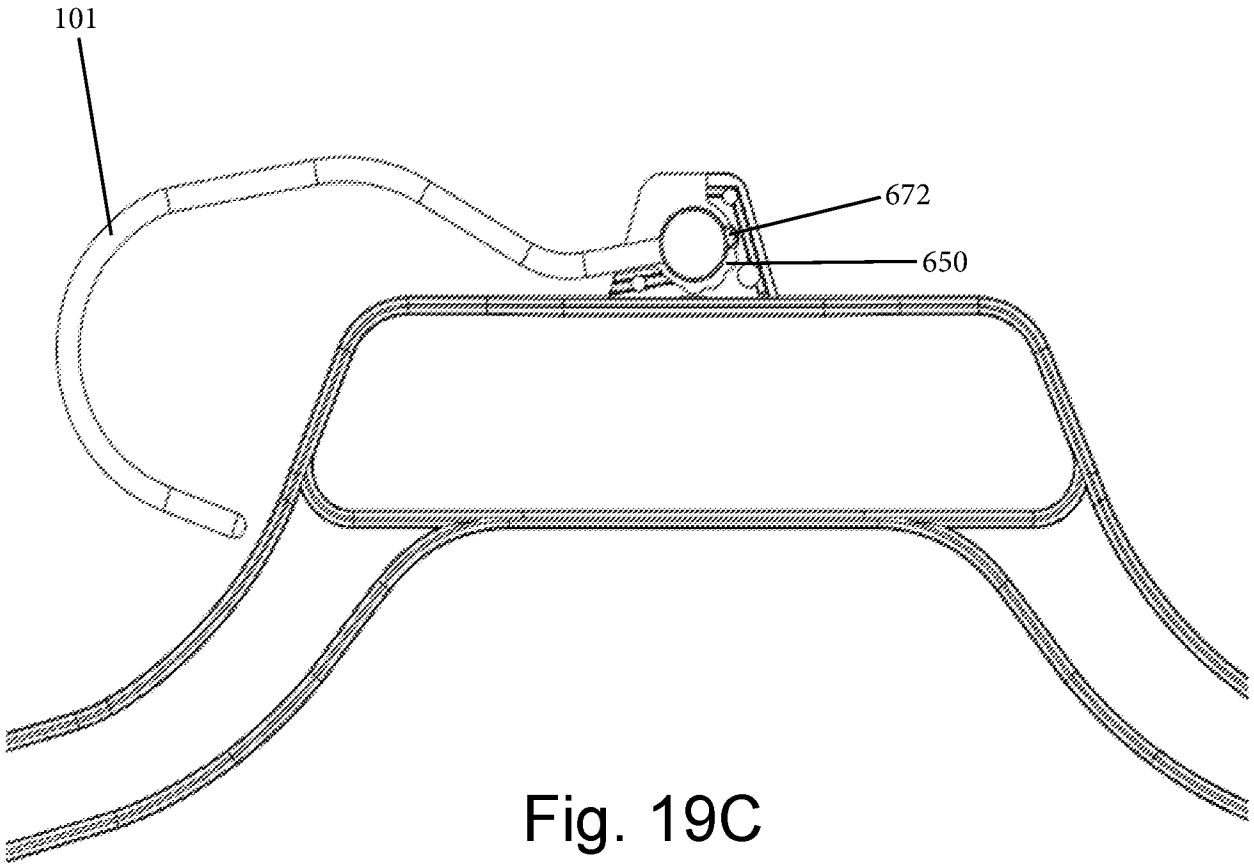
Figure 20:
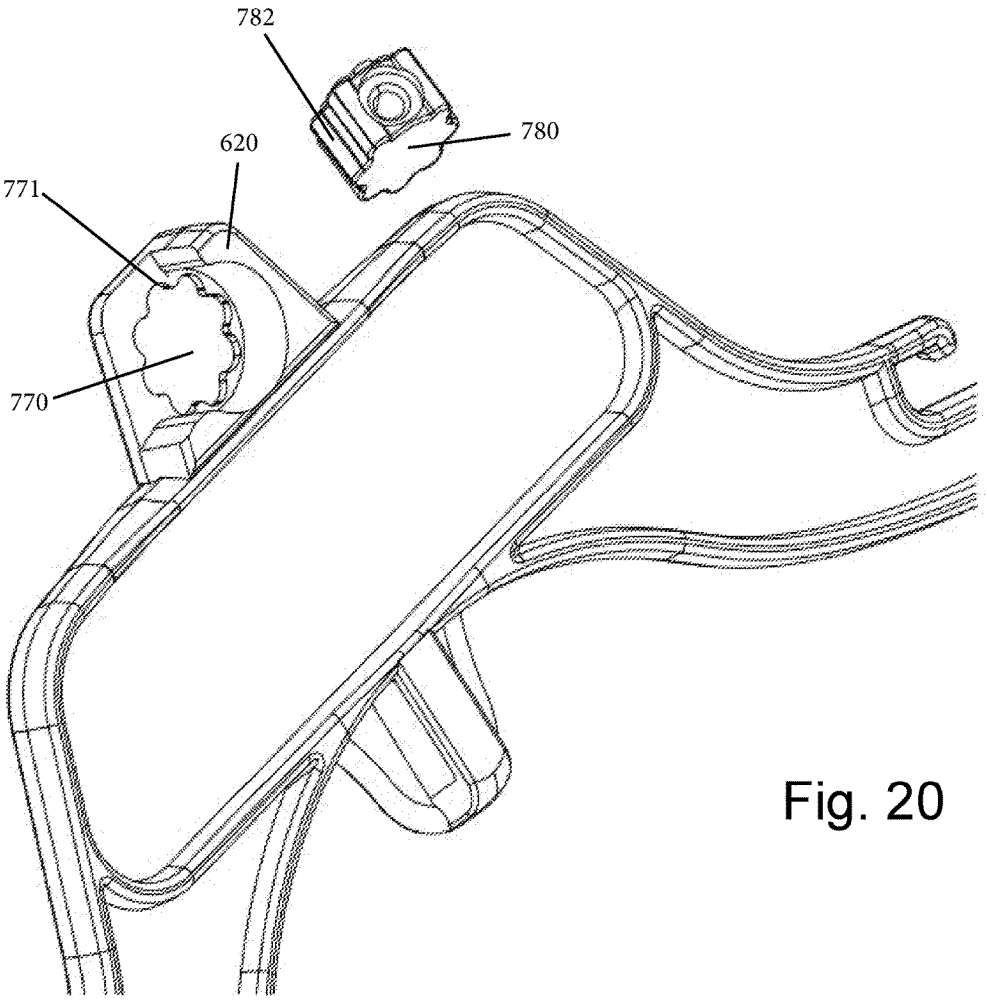
Figure 21B:
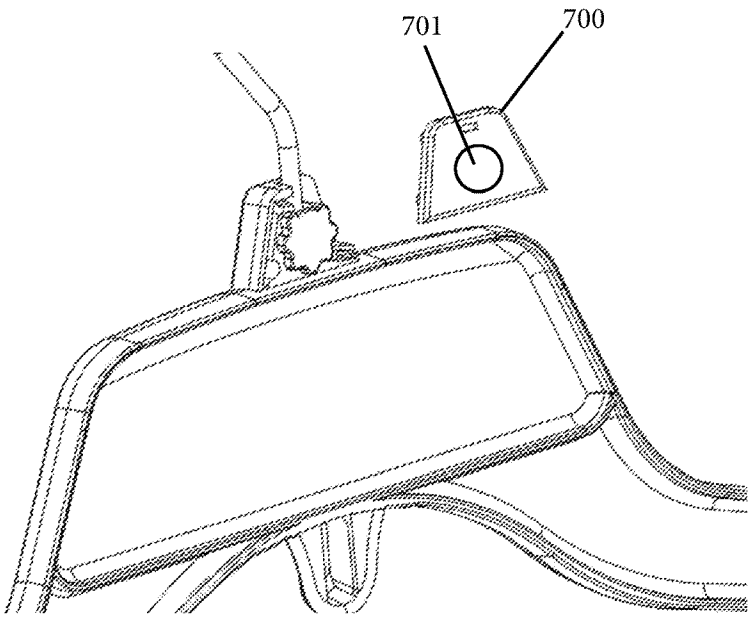
Figure 21A:
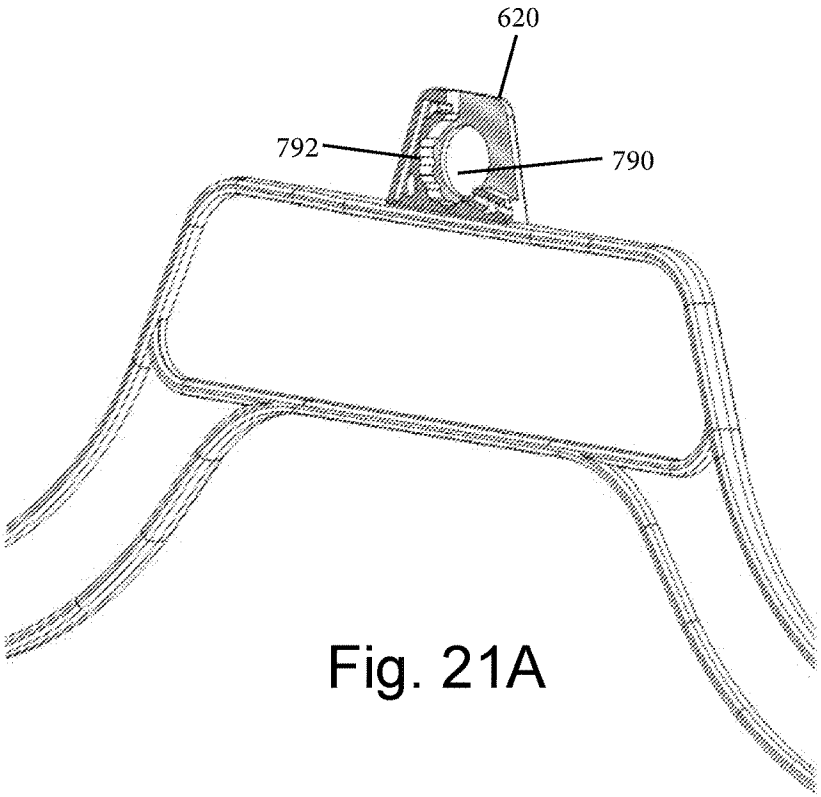
Figure 22:
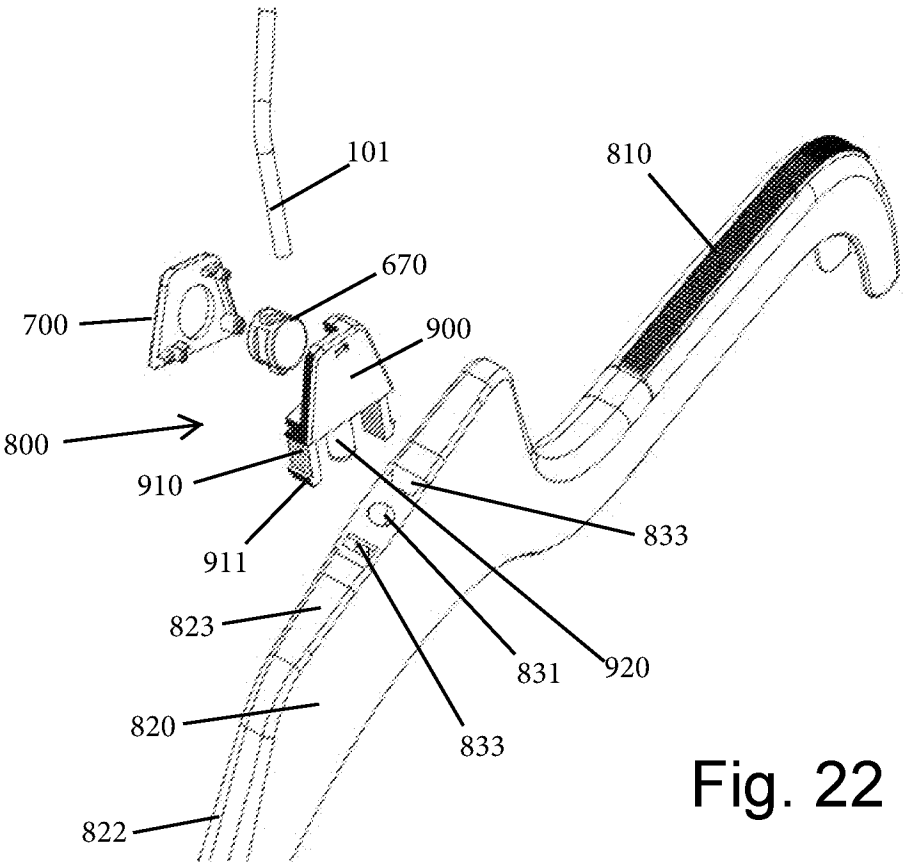
Figure 23B:
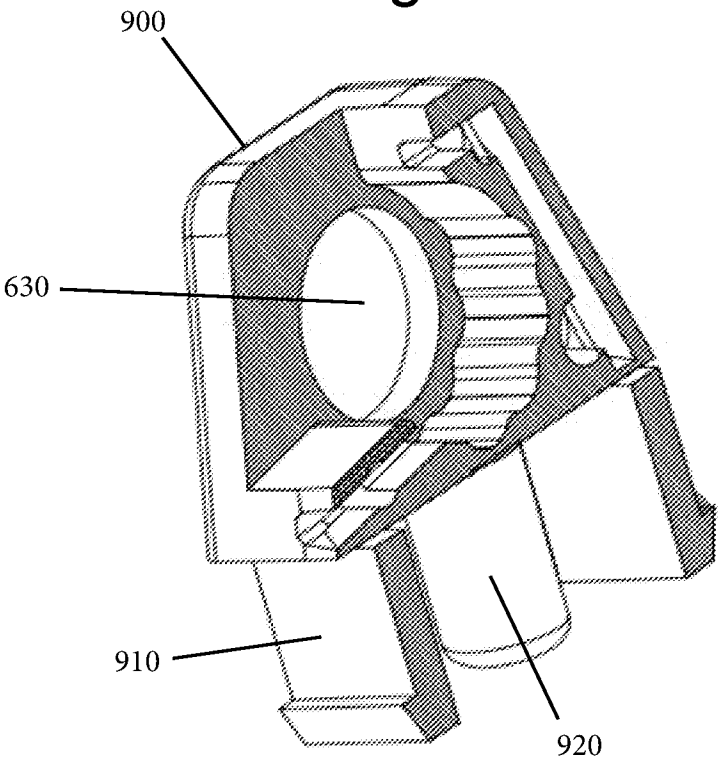
Figure 23A:
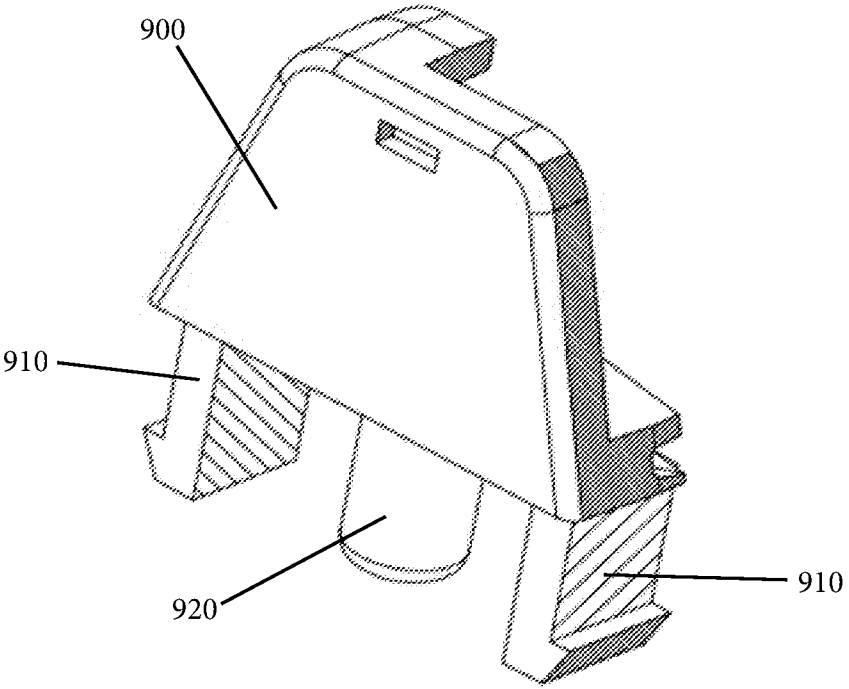
Figure 24B:
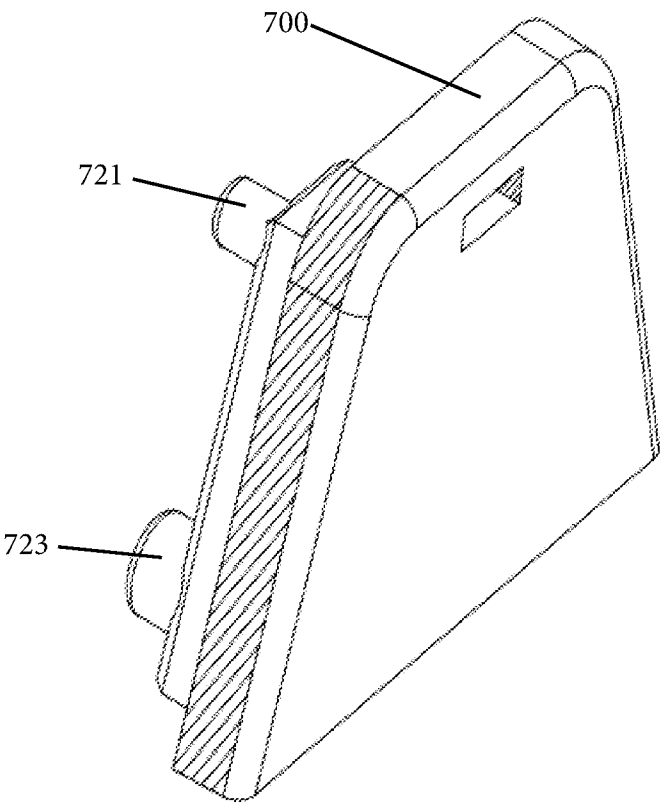
Figure 24A:
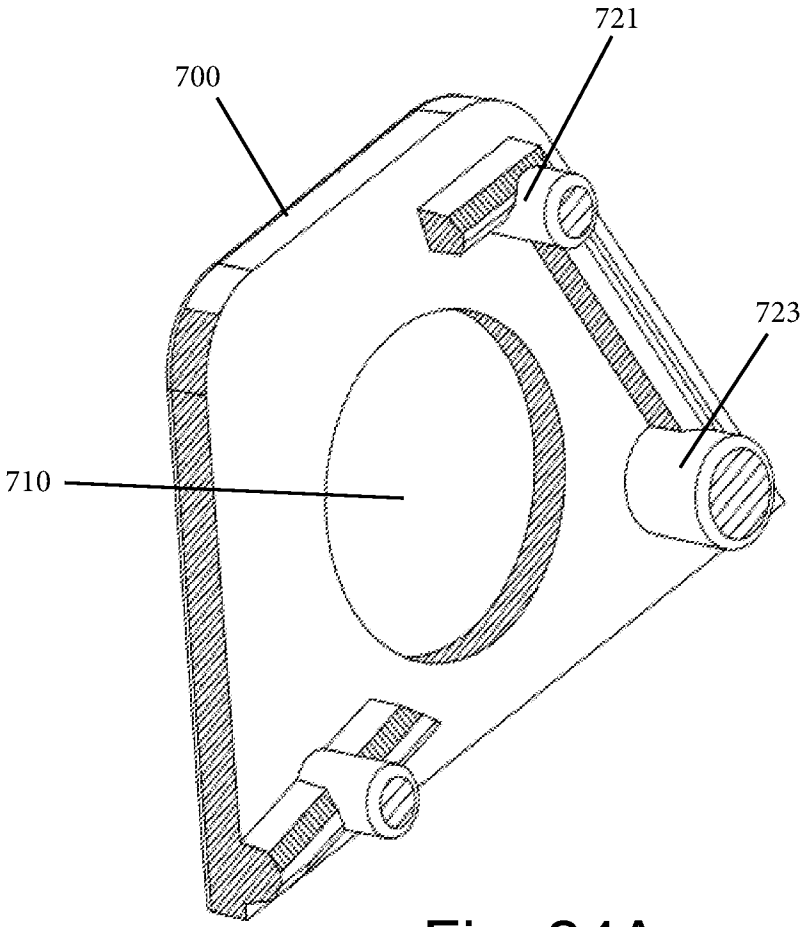
Figure 25:
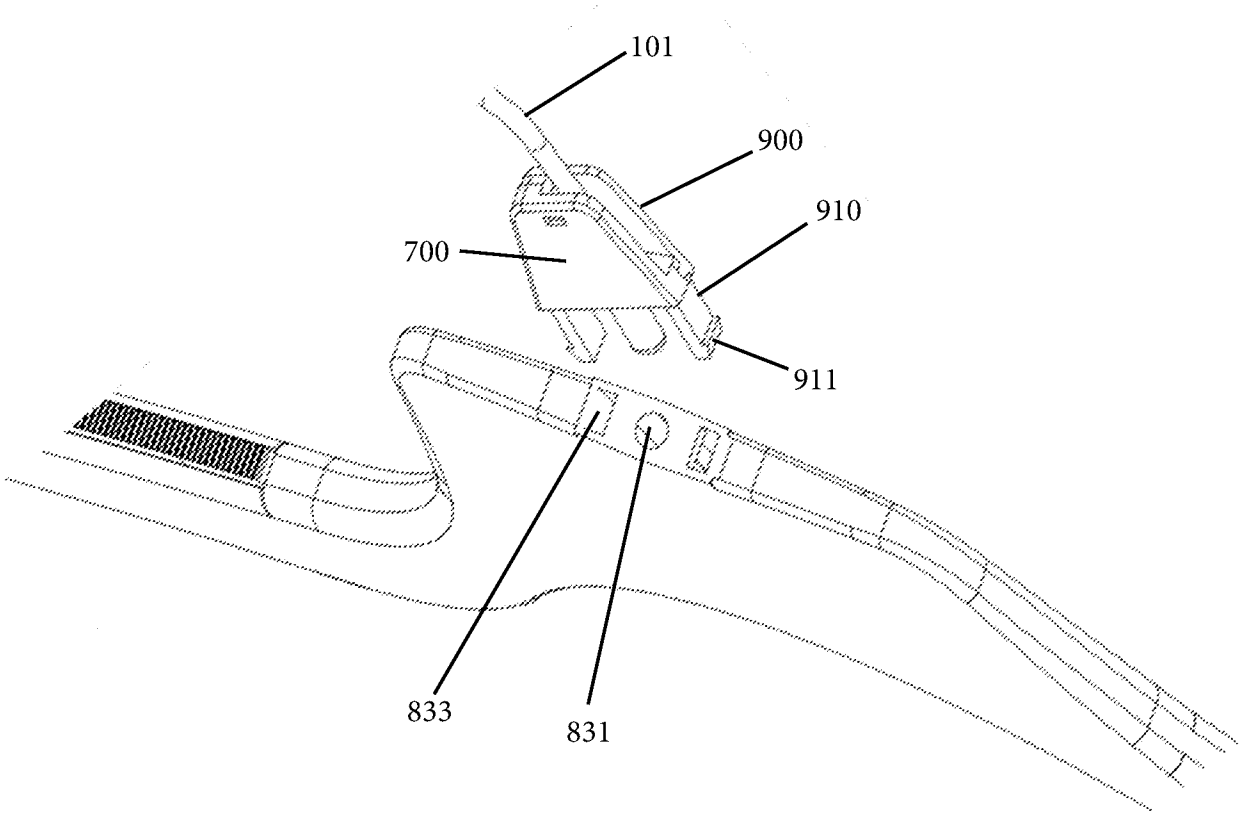

FIGS. 10A-C illustrate the use of a tool to stabilize the axle member while the hook is mated thereto;

FIG. 11 is an exploded view of a collapsible hook for a garment hanger according to another embodiment;

FIG. 12 is a perspective view of a first side wall of the collapsible hook of FIG. 11;

FIG. 13 is a perspective view of an axle drum that forms part of the collapsible hook of FIG. 11;

FIG. 14 is a perspective view showing the axle drum inserted into a cavity of the first side wall;

FIG. 15 is a perspective view of a second side wall that is configured for attachment to the first side wall;

FIG. 16 is a perspective view of the first and second side walls attached to one another with the axle drum;

FIG. 17 is a perspective view of a sizer for use with the collapsible hook of FIG. 11;

FIG. 18 is a perspective view showing placement of the sizer over the collapsible hook;

FIGS. 19A-C show rotation of the axle drum into different positions within the first side wall resulting in pivoting of the hook;

FIG. 20 is an exploded perspective view of a first side wall and axle drum according to a different embodiment;

FIG. 21A is a perspective view of a first side wall according to a different embodiment;

FIG. 21B is another perspective view of a second side wall of the embodiment of FIG. 21A;

FIG. 22 is an exploded perspective view of a collapsible hook according to yet another embodiment;

FIG. 23A is a perspective view of an outer surface of a first side wall of the collapsible hook;

FIG. 23B is a perspective view of an inner surface of the first side wall of the collapsible hook;

FIG. 24A is a perspective view of an outer surface of a second side wall of the collapsible hook;

FIG. 24B is a perspective view of an inner surface of the second side wall of the collapsible hook; and FIG. 25 is an exploded perspective view of a collapsible hook assembly configured for insertion into and attachment of a center portion of a garment hanger beam.

DETAILED DESCRIPTION OF CERTAIN EMBODIMENTS

FIGS. 1-3, 7 and 8 illustrate an exemplary garment hanger 100 that includes a crossbar 110 that defines a first end 112 and an opposing second end 114. Hanger 100 also includes a central portion 120 that defines a hook receiving area. In particular, the central portion 120 includes a hook receiving body 200 that is integral to and extends outwardly from a top edge 111 of the cross bar 110.

The hook receiving body 200 is defined by a first side wall 210, an opposing second side wall 220, a first end wall 230 that connects the first side wall 210 and the second side wall 220, and a second end wall 240 that also connects the first side wall 210 and the second side wall 220. The first and second side walls 210, 220 are parallel to one another and the first side wall 210 can be thought of as being a front wall and the second side wall 220 can be thought of as being a rear wall. The first and second end walls 230, 240 can be angled (other than 90 degrees) relative to the top edge of the cross bar 110.

The four walls 210, 220, 230, 240 define a hollow interior space 245 that is open along its top since there is no wall structure that extends across the top edges of the four walls 210, 220, 230, 240. Thus, the hook receiving body 200 includes a top opening 201 which, as described below, is configured to receive a hook 101.

The first end wall 230 can be a completely solid wall that extends between the first and second side walls 210, 220. In contrast, the second end wall 240 includes an opening that communicates with the top opening so as to define a generally L-shaped hook receiving slot 235.

The first side wall 210 has an opening 240 formed therein. More specifically, the opening 240 defines an entrance into the hollow interior space 245 defined within the hook receiving body 210. The opening 240 is a through hole that can have any number of different shapes and in the illustrated embodiment, the opening 240 has a generally circular shape. The opening 240 can be centrally formed in the first side wall 210.

The opposing second side wall 220 has an exterior surface 221 and an opposing interior surface 223. The second side wall 220 is a completely solid structure unlike the first side wall 210 that includes the opening 240. The exterior surface 221 is preferably a smooth surface, while the interior surface 223 has a recess 250 integrally formed therein. The recess 250 has a defined shape and size. It will be appreciated that the recess 250 can have any number of different shapes and different sizes and in the illustrated embodiment, the recess 250 has a generally circular shape. The recess 250 also has a selected depth as described herein; however, the recess 250 is not a through hole as shown.

The recess 250 is axially formed with the opening 240 and in one embodiment, the axis is a central axis that passes through the centers of both the recess 250 and the opening 240 even though the size of the recess 250 is different than the size of the opening 240. As shown, the recess 250 has a smaller diameter relative to the diameter of the opening 240.

The garment hanger 100 also includes an axle member 300 that is configured to be securely attached to the hook of the hanger. As mentioned, the hook is often formed of metal and has a threaded end. The axle member 300 is a substantially solid structure; however, the axle member 300 does include a threaded bore 301 which is configured to receive the threaded end of the hook so as to securely attach the hook to the axle member 300. It is possible that the axle member 300 can be thought of as being a plug or a barrel.

As shown in the figures, the axle member 300 can be thought of as an integral multi-portioned structure. In other words, the axle member 300 has a series of stacked sections (portions) as described herein. More specifically, the axle member 300 includes a first section 310, a second section 320 and a third section 330, with the second section 320 being located between the first and third sections 310, 330.

The third section 330 is configured to be intimately received within the recess 250. The third section 330 is rotatably received within the recess 250 and therefore has a complementary shape and size relative to the shape and size of the recess 250. In the illustrated embodiment, the recess 250 has a circular shape and thus, the third section 330 which is in the form of a protrusion that extends outwardly from one face of the second section 320 also has a circular shape.

The shape of the third section 330 is selected such that the third section 330 is free to rotate within the recess 250. The fit between the third section 330 and the recess 250 assists in holding the axle member 200 in place within the hollow interior space 245. As shown in the figures, the thickness (height) of the third section 330 is much less than the thicknesses of each of the second section 320 and the first section 310. In other words, the thickness of the third section 330 is selected so as to securely and rotatably couple the axle member 300 to the hook receiving body 200 without having the third section 330 inadvertently slip or otherwise fall out of the recess 250 during rotation therein, etc.

When the axle member 300 is inserted into the hollow interior space 245, the third section 330 represents the innermost section of the axle member 300, while the first section 310 represents the outermost section of the axle member 300 which is visible within the opening 240 of the first side wall 210.

The second section 320 can have any number of different shapes and in the illustrated embodiment, the second section 320 has an oblong or oval shape. The shape of the second section 320 is at least in part dictated by the fact that the second section 320 is the portion that receives the threaded end of the hook. The second section 320 thus contains the threaded bore 301 that threadingly mates with the threaded end of the hook so as to securely attach the hook to the axle member 300. As shown, the threaded bore 301 is formed in one end of the second section 320.

As shown, the second section 320 has a greater footprint than the third section 330 and actually surrounds the third section 330. A first shoulder 323 is formed between the second section 320 and the third section 330. A second shoulder 325 is formed between the second section 320 and the first section 310.

The first section 310 is configured to be received within the opening 240. The illustrated first section 310 has a disk shaped base 319 (e.g., circular shaped section) with the second section 320 being integral thereto and extending outwardly from one face 311 of the disk shaped base 319 of the first section 310. The face 311 of the disk shaped base 319 includes a peripheral rim (locking ridge) 315 that extends around a periphery of the first section 310 at the face 311. The peripheral rim 315 extends radially outward from the face 311 of the disk shaped base 319 so as to create the peripheral rim 315 which overhangs the remaining body 319 of the first section 310. Since the illustrated first section 310 has a circular shape, the illustrated peripheral rim 315 likewise has a circular shape. As shown, the peripheral rim 315 can include a plurality of notches 317 formed therein and spaced apart from one another. As shown in the figures, the peripheral rim 315 extends not only above the face 311 but also extend radially outward therefrom so as to create the overhang.

The peripheral rim 315 can generally have a general triangular shape as shown. This triangular shape is thus defined by a beveled/sloped edge 316 and a flat undercut edge 318. The undercut edge 318 lies in a plane that is parallel to the plane that contains the face 311.

The peripheral rim 315 acts as a locking ridge to securely attach the axle member 300 within the hollow interior space 245 of the hook receiving body 200 yet still permit the axle member 300 to freely rotate within the interior space 245 so as to allow the axle member 300 to assume one of a plurality of positions which when the hook is attached to the hook receiving body 200 allows the pivot relative to the hook receiving body 200. This pivoting action of the hook receiving body 200 translates into pivoting of the hook between an extended (upright) position and a collapsed (folded) position. In particular, the disk shaped base 319 has dimensions (e.g., diameter) that is only slightly less than the dimensions (e.g., diameter) of the opening 240; however, the peripheral rim 315 has dimensions (e.g., diameter) that is slightly greater than the dimensions (e.g., diameter) of the opening 240. The peripheral rim 315 is configured and formed of a material (e.g., plastic) that allows for at least slight flexing thereof to allow a mechanical (interference) fit to be achieved between the axle member 300 and the hook receiving body 200. More specifically, when the axle member 300 is inserted into the hollow interior space 245 through the opening 240, the beveled edge 316 first contacts the outer face of the first side wall 210 and due to its beveled nature, the edge 316 acts as a cam, thereby causing a flexing of the peripheral rim 315.

Figure 1:
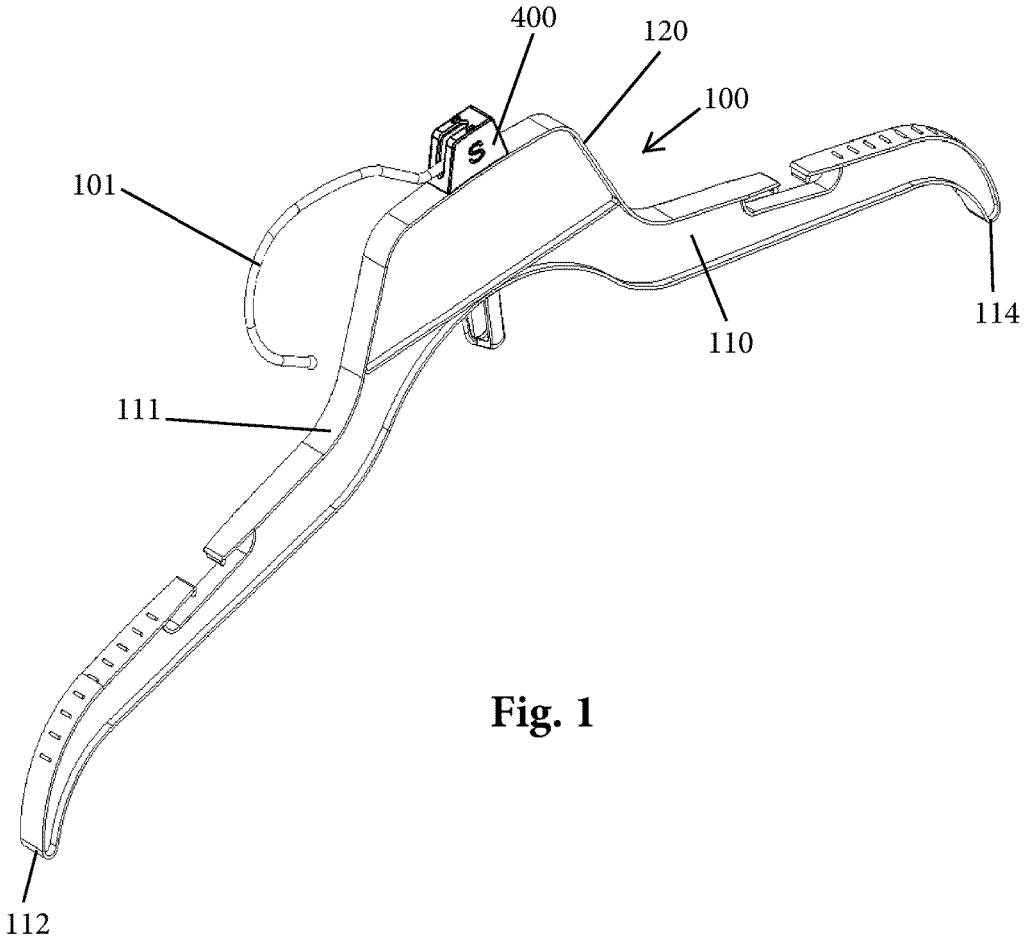
FIG. 1 is a top and side perspective view of a garment hanger with a collapsible hook.
Figure 2:
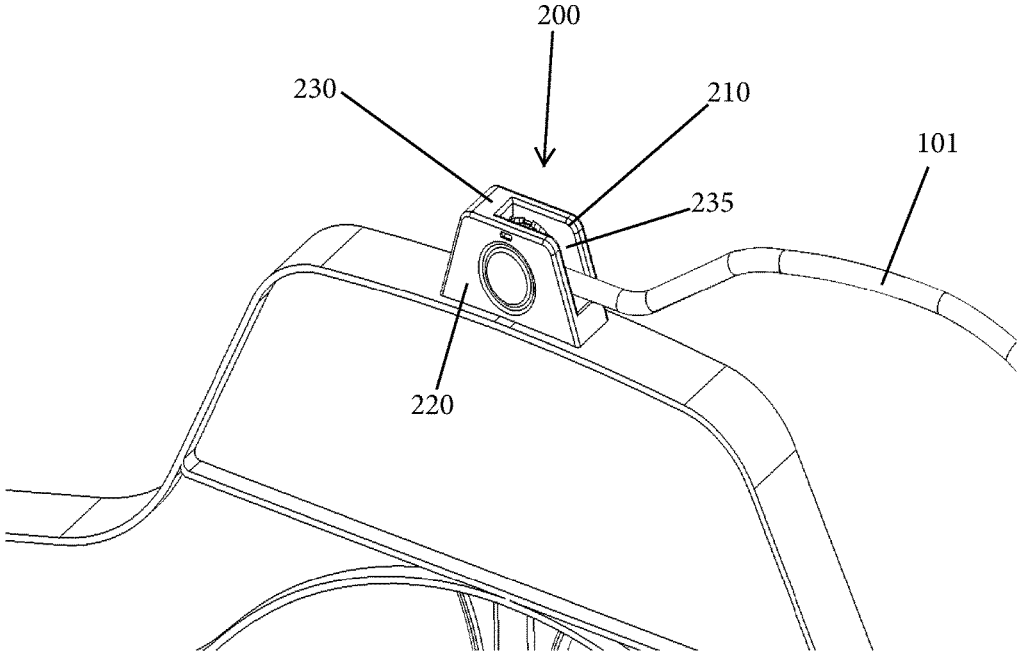
FIG. 2 is a close-up first side perspective view of a hook receiving body that mates with a hook of the hanger.
Figure 3:
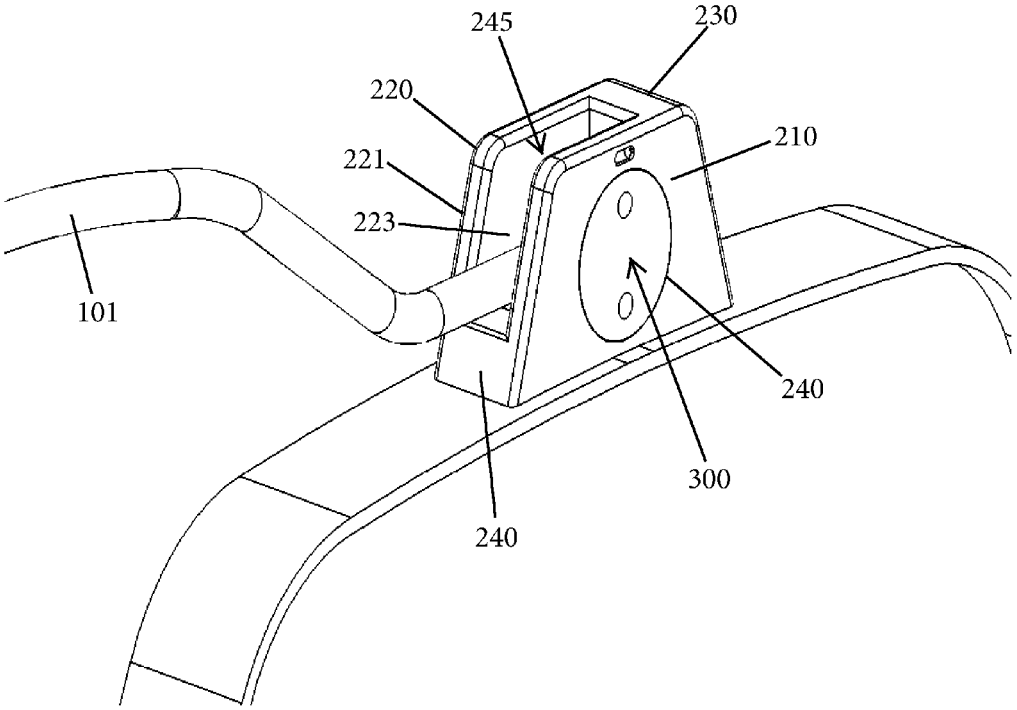
FIG. 3 is a close-up second side perspective view of the hook receiving body.
Figure 4:
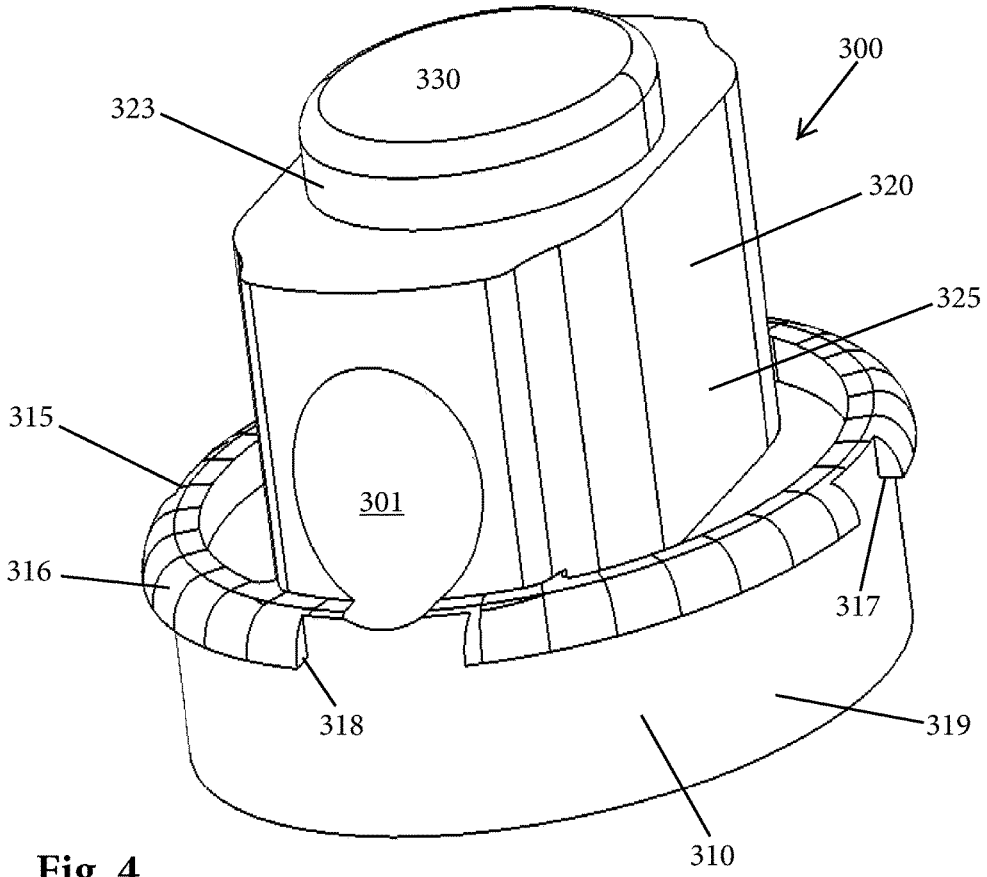
FIGS. 4-6 are perspective views of an axle member that is rotatably received in the hook receiving body.
Figure 5:
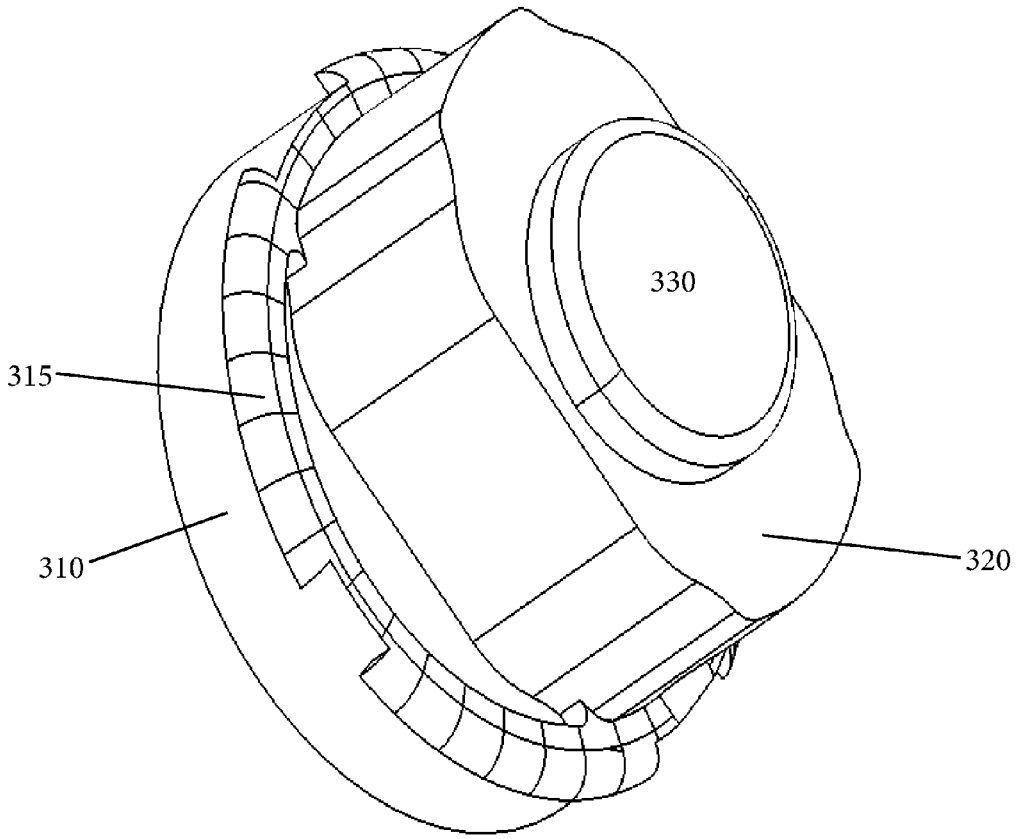
Figure 6:
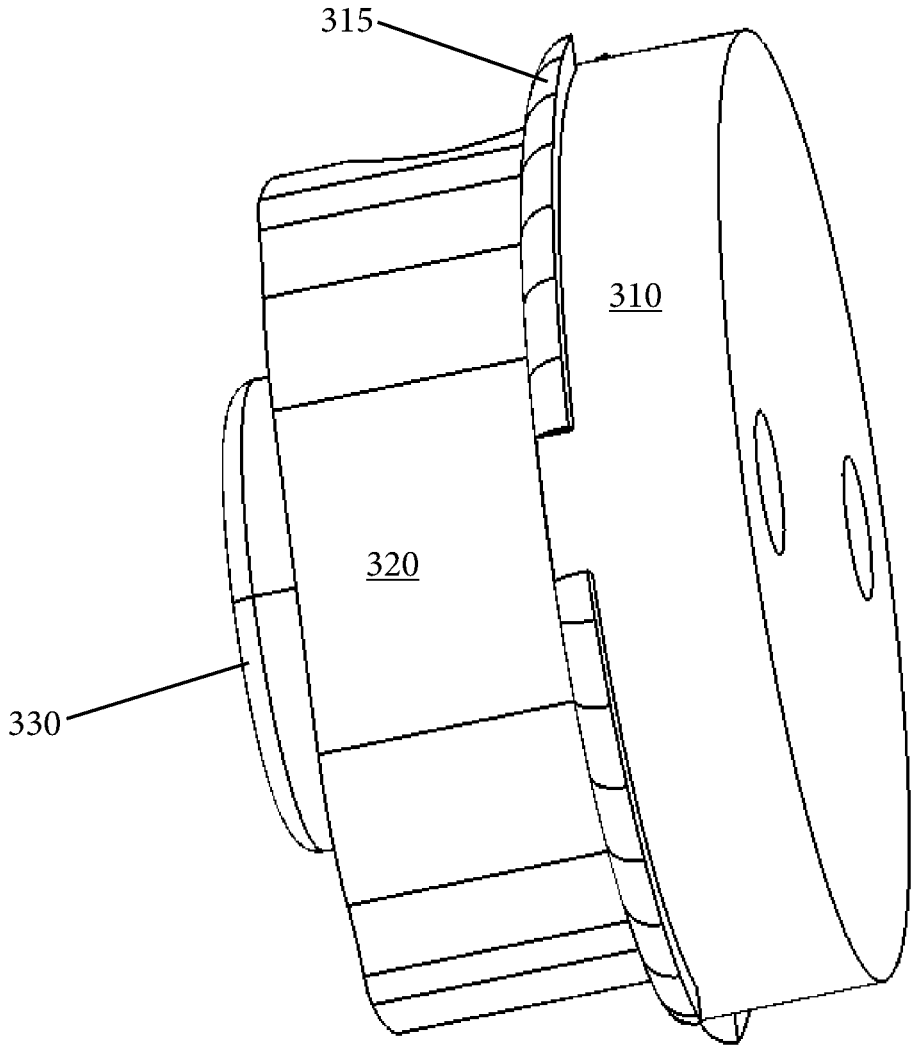
Figure 7:
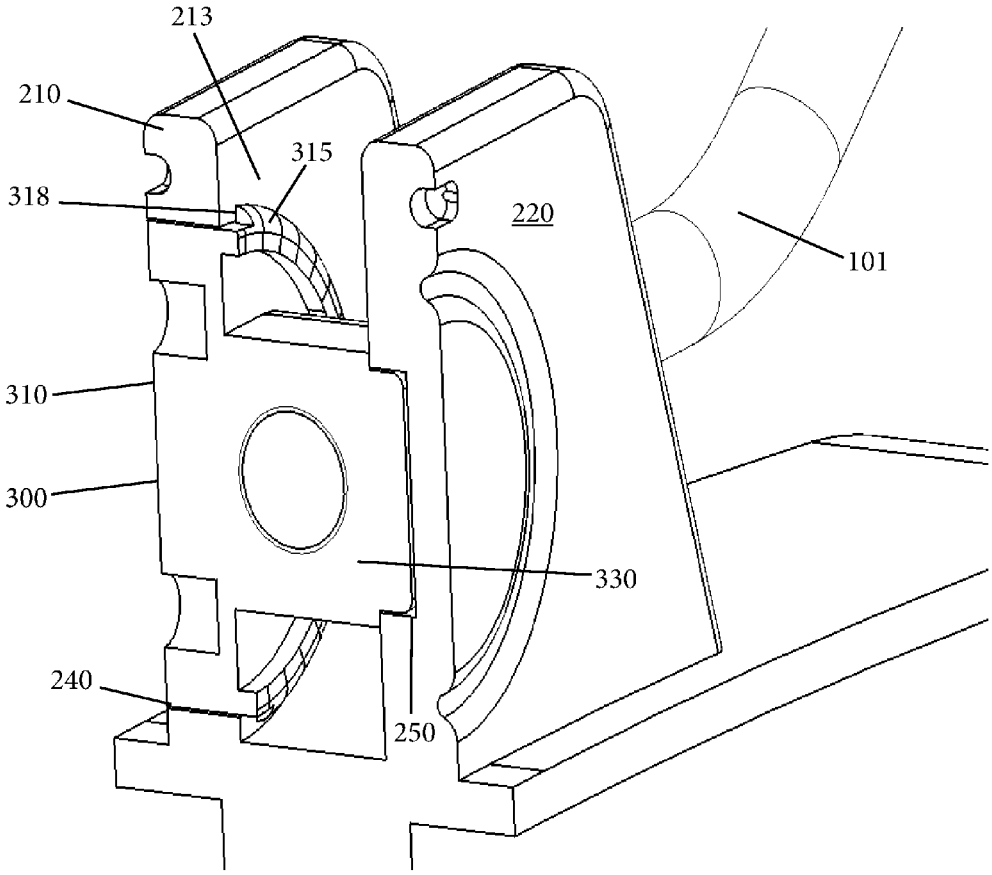
FIGS. 7-8 are cross-sectional views through the hook receiving body and axle member attached thereto.
Figure 8:
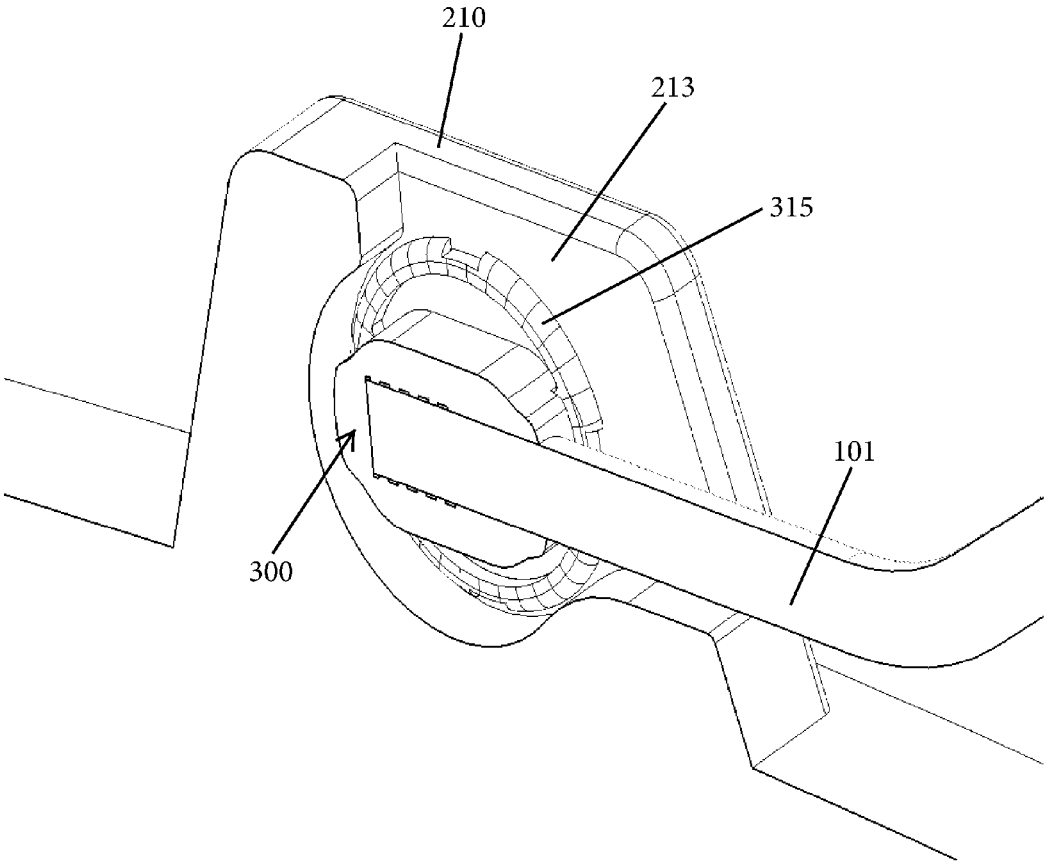

Once the axle member 300 is inserted a sufficient distance, as described below, the peripheral rim 315 clears an inner face 213 of the first side wall 210, the peripheral rim 315 flexes outward to return to its at rest (relaxed) position. As shown in FIG. 7, when the peripheral rim 315 assumes this locked position, the undercut edge 318 seats against the inner face 213 of the first side wall 210. Thus, a snap fit results between the axle member 300 and the hook receiving body 200. This locking action results in the axle member 300 being locked in place within the hook receiving body 200 yet still permits the axle member 300 to freely rotate within the hook receiving body 200.

The complete manner of coupling the axle member 300 to the hook receiving body 200 is now described. The axle member 300 is first positioned such that the third section 330 faces the first side wall 210. The axle member 300 is then passed through the opening 240 with the third section 330 being inserted first into the hollow interior space 245. The third section 330 is then directed to and inserted into the recess 250. The third section 330 thus acts as a protrusion that seats within the recess 250. As mentioned, the third section 330 can thus be thought of as a hub that locates and stabilizes the axle member 300 within the hook receiving body 200, while still permitting rotation of the axle member 300.

As the third section 330 travels within the hollow interior space 245 toward the recess 250, the peripheral rim 315 engages the first side wall 210, as described herein, with the peripheral rim 315 flexing to permit insertion of the axle member 300 into the hollow interior space 245. At the time that the peripheral rim 315 clears the first side wall 210, the third section 330 is rotatably contained within the recess 250.

The containment of the third section 330 in the recess 250 secures the inner end portion of the axle member 300 within the hook receiving body 200 and the peripheral rim 315 and the containment of the axle member 300 within the opening 240 secures the outer end portion of the axle member 300 within the hook receiving body 200. The locking of the peripheral rim 315 prevents any unintended dislodgment of the axle member 300 from the hook receiving body 200. The axle member 300 is thus held in a generally perpendicular orientation relative to the side walls 210, 220. In this manner, the axle member 300 is contained and supported within the hook receiving body 200. Preferably, when the axle member 300 is fully inserted and locked in place within the hook receiving body 200, the outer surface (face) of the first section 310 lies at least substantially flush with or slightly recessed with respect to the first side wall 210.

The axle member 300 is thus locked in place (e.g., snap fit) by inserting the axle member 300 into the hollow interior space 245. An audible click or at least a tactile click is felt when the axle member 300 is inserted into and locks with the hook receiving body 200. As shown in the figures, when the axle member 300 is locked in place in the hook receiving body 200, the threaded bore 321 and is axially aligned with and in communication with the hook receiving slot 235 so as to permit the hook to be inserted into and pass through the hook receiving slot 235, thereby allowing the hook to mate to and move with the axle member 300. It will be appreciated that the ends of the hook receiving slot 235 define the ends of travel for the hook. One end of the hook receiving slot 235 is located such that when the hook is positioned at this end, the hook is in a fully extended position in which the hook is generally perpendicular to the cross bar 110. Conversely, when the hook is at the other end of the hook receiving slot 235, the hook is in a fully collapsed position and the hook is oriented generally parallel to the cross bar 110.

Figure 9:
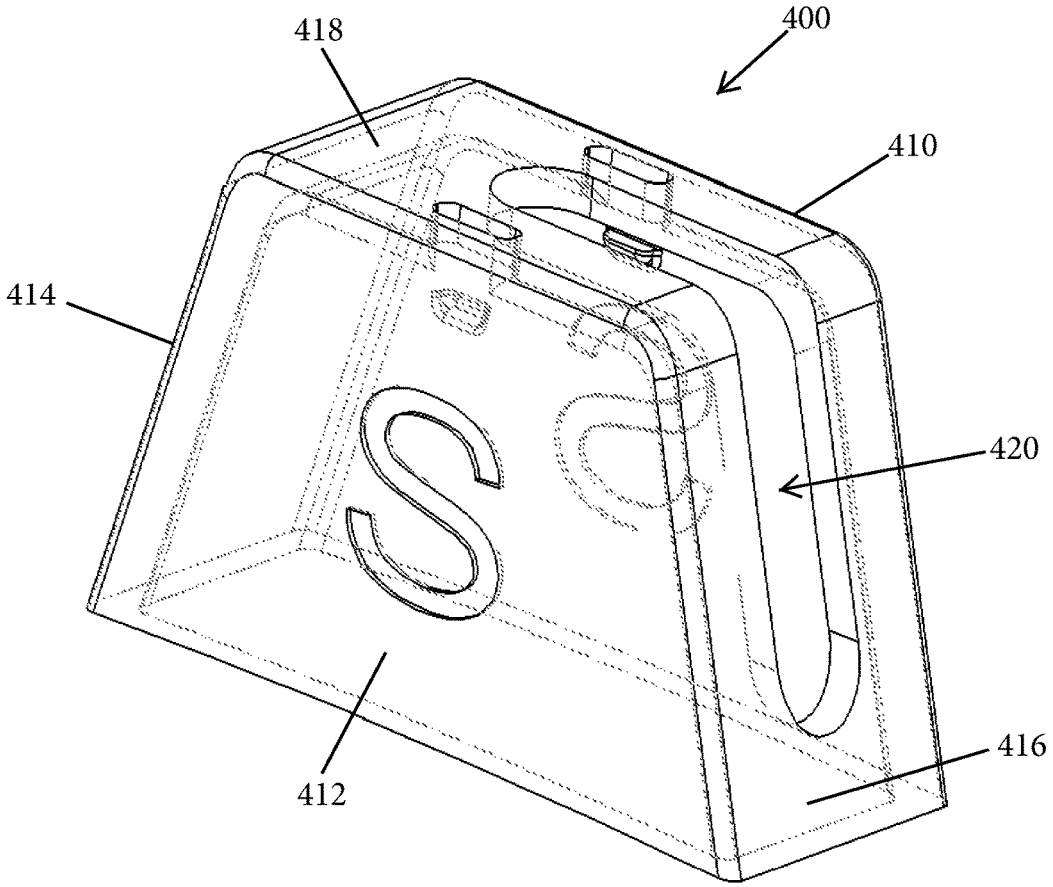
FIG. 9 is a perspective view of a top sizer for reception on the hook receiving body.

FIG. 9 also illustrates that a top sizer 400 can be placed over the hook receiving body 200 and is constructed to accommodate the hook. The top sizer 400 is thus a substantially hollow structure defined by five walls or faces. More particularly, the cross sizer 400 has first and second opposing side walls 410, 412; first and second end walls 414, 416 and a top wall 418. The first and second side walls 410, 412 are completely solid as is the end wall 414; however, the other end wall 416 and the top wall 418 have openings that define a slot 420 which at least substantially mirrors the hook receiving slot 235. In fact, the slot 420 also acts as a hook receiving slot in that the hook passes therethrough and must be able to move therein between the fully extended and fully collapsed positions of the hook.

FIGS. 10A-C illustrate the use of a tool to stabilize the position of the axle member 300 prior to and during the mating of the hook 101 to the opening (recess) 301 of the axle member 300. More specifically, the opening 301 for the hook 101 should be facing upward vertically when the hook 101 is inserted into and mated with the opening 301 to couple the hook 101 to the axle member 300. While the hook 101 is being threadingly mated with the opening 301 of the axle member 300, it is desired to maintain the position of the axle member 300 and prevent rotation of the axle member 300. FIG. 10A shows the use of a tool 500 that has a pair of legs that are received within openings (recesses) 303 formed in the planar outer face of the first section 310 of the axle member 300. The insertion of the tool 500 into openings 303 fixes and maintains the axle member in a desired orientation (i.e., prevents rotation of the axle member 300). FIG. 10B shows the use of a mold component 510 that is similar and has a pair of protrusions (rods) that are received in the openings 303 to maintain the axle member in the desired orientation. FIG. 10C shows the insertion of a hexagonal shaped tool 520 into a hexagonal shaped opening (recess) 305.

FIGS. 11-19C illustrate a garment hanger 600 having a collapsible hook according to another embodiment of the present invention. The garment hanger 600 is similar to garment hanger 100 and includes the central portion 120 that defines a hook receiving area. In particular, the central portion 120 includes a hook receiving body (assembly) 610 that is integral to and extends outwardly from the top edge 111 of the cross bar 110. The hook receiving body 610 includes a first side wall 620 that is integrally formed with the central portion 120 as by being formed during a common molding operation in which the cross bar 110 is formed. The first side wall 620 can have parallel top and bottom edges and inwardly tapered side edges and includes a first (outer) face 622 and an opposing second (inner) face 624. As shown, the first face 622 can be a smooth face; however, it will also be understood that the first face 622 can have a protruding portion as discussed below. The inner face 624 includes a number of features including a recessed portion 630. As shown, the recessed portion 630 can have a circular shape and can be centrally located in the inner face.

The inner face 624 also includes a number of protruding portions disposed about the recessed portion 630. The inner face 624 includes a first side raised portion 640 formed along one side edge of the first side wall 620. The first side raised portion 640 protrudes outwardly from the inner face 624 and an inner side edge thereof has a scalloped shape in that there are a series of adjacent scalloped shaped notches 650 that are formed about the recessed portion 630. The first side raised portion 640 also includes a raised peripheral edge 642 that extends partially along the top edge of the first side wall 620 and along one side edge thereof. The first side raised portion 640 includes at least one bore and in particular, the first side raised portion 640 includes two or more bores (holes) 645, 647. The two bores 645, 647 can have the same shape and/or same dimensions or they can have different shapes and/or different dimensions (e.g., diameters). The bores 645, 647 are formed between the scalloped shaped notches 650 and the side edge.

The inner face 624 also includes a second side raised portion 660 that is located along a second side edge of the first side raised portion 640. The second side raised portion 660 has a bore (hole) 661 formed therein.

An axle drum 670 is configured to be rotatably contained within the recessed portion 630. As shown, the axle drum 670 can have a generally circular shape and includes at least one protrusion 672 that extends radially outward therefrom. The axle drum 670 can also include one or more notches 675 formed therein along a side wall thereof between an inner face 673 and outer face 676 of the axle drum 670. The axle drum 670 also has a hook receiving portion 677 that receives one end of the hook 101 and in particular, a threaded end of the hook 101. The hook receiving portion 677 can thus be in the form of a threaded hole 679 that receives the threads of the hook 101. In the illustrated embodiment, the protrusion 672 is generally opposite the hook receiving portion (threaded hole) 677. The illustrated protrusion 672 is rounded and in particular, can be in the form of a hump, such as being semi-circular in shape. As described herein, the protrusion 672 is configured to seat within one of the scalloped shaped notches 650 as the axle drum 670 is received within the recessed portion 630. The combination of the protrusion 672 with the notches 650 thus presents a gear type arrangement between the two parts.

As can be seen from FIG. 14, the hook 101 has a limited range of rotation and in particular, an inner edge of the first side raised portion 640 acts as a stop and the second side raised portion 660 acts as a different stop. The hook 101 thus can pivot (rotate) between the first and second raised portions 640, 660. As shown in FIG. 14, when the hook 101 is in a fully upright position (i.e., an in use position), the protrusion 672 is received in a bottommost notch 651. As the hook 101 rotates toward a collapsed position (e.g., clockwise rotation from the upright position), the protrusion 672 dislodges from the bottommost notch 651 and moves clockwise and encounters successive notches 650. Each time, the protrusion 672 rotates, a force is needed to cause the protrusion 672 to slide out of its notch 650 and then the protrusion 672 enters into the next notch 650. The materials used to form the axle drum 670 and the first side wall 620 are selected so that the protrusion 672 can move into and out of notches 650 as the hook 101 rotates. When the hook 101 is in the collapsed position, the protrusion 672 is in one of the uppermost notches 650.

It will be appreciated that the first and second raised portions 640, 660 serve to locate and contain the axle drum 670 within the first side wall 620.

The collapsible hook also includes a second side wall 700 (FIG. 15) that in combination with the first side wall 620 forms the hook receiving body 610 (collapsible hook body). The second side wall 700 is configured to mate with the first side wall 620 to form a hook receiving body assembly that contains and securely holds the hook 101 in such a way that the hook 101 can pivot in the manner described herein as shown in FIG. 16.

The second side wall 700 includes a first (outer) face 702 and a second (inner) face 704. In one embodiment, the first face 702 can be a smooth surface or alternatively, the first face 702 can include a local protrusion that extends outwardly therefrom. Similar to the first side wall, the second face 704 of the second side wall 700 includes a recessed portion 710. The recessed portion 710, like the recessed portion 630, can be a circular shaped recess that is centrally located. The recessed portion 710 receives the axle drum 670 such that the axle drum 670 can rotate within the recessed portion 710.

The second side wall 700 preferably has a shape that is complementary to the first side wall 620 and in particular, the illustrated second side wall 700 has parallel top and bottom edges and inwardly tapered side edges. In other words, the second side wall 700 can have a footprint that is at least substantially the same as the first side wall 620 such that when the first and second side walls 620, 700 are coupled to one another, a structure is formed that has clean lines.

The inner face 704 of the second side wall 700 also includes raised portions that are complementary to the raised portions formed along the inner face of the first side wall. The inner face 704 includes a first raised rail 720 that is formed along one of the side edges of the second side wall 700 and at least partially extends along the top edge thereof. The first raised rail 720 thus generally has an L shape. The inner face 704 includes a second raised rail 730 that is located in a bottom corner opposite the side that contains the first raised rail 720. Along the first raised rail 720 are one or more protrusions and in the illustrated embodiment, the first raised rail 720 includes two protrusions 721, 723 that are spaced apart from one another. The two protrusions 721, 723 are sized and shaped so as to be complementary to the two bores 645, 647. As part of the manner for attaching the first side wall 620 to the second side wall 700, the first and second side walls 620, 700 are aligned relative to one another and the protrusions 721, 723 into the two bores 645, 647, respectively. Similarly, the second side wall 730 includes a protrusion 725 that is configured for reception into the bore 661 formed within the second side raised portion 660. FIG. 16 shows reception of the protrusion 725 into the bore 661. The first side wall 620 can include a groove 629 that intersects the bores 645, 647 and another groove 631 intersects the bore 661. The groove 629 receives the first raised rail 720 and the groove 631 receives the second raised rail 730 so as to form an assembled housing structure that contains the axle drum in a rotatable manner.

As shown in the figures, one side of the assembled structure is a closed wall, while the other side and at least a substantial portion of the top of the assembled structure is open so as to define a slot 750 that accommodates the hook 101 which passes therethrough. In the upright position, the hook 101 passes through the top portion of the slot 750 and as the hook 101 pivots to the collapsed position, the hook 101 passes through the side portion of the slot 750 defined along one side of the assembly.

It will be appreciated that any number of different means/techniques can be used to couple the first and second side walls 620, 700 to one another. For example, a mechanical fit can be formed between the two as by a snap-fit fastening arrangement or alternatively, a bonding or weld can be formed between the two after the axle drum is inserted into the recessed portion formed in the first side wall. In the embodiment in which the first side wall 620 is integral to the central portion of the hanger bar, the axle drum 670 is inserted into the recessed portion of the first side wall 620, then the second side wall 700 is positioned and coupled to the first side wall 620 using the techniques mentioned herein or by using other suitable techniques.

FIGS. 17 and 18 illustrate a top sizer 760 for use with the collapsible hook structure described above. The top sizer 760 is a hollow structure defined by first and second side walls 761, 762 and end walls 763, 764 and a top wall 765. The top wall 765 has an enlarged central opening 768 that opens into a side slot 769 to form a slot that accommodates the pivoting movement of the hook 101. The top sizer 760 is thus sized and shaped to be received over the collapsible hook structure such that the top sizer 760 covers the collapsible hook structure.

FIGS. 19A-C show the pivoting of the hook 101 within the first side wall 620. FIG. 19A shows the hook 101 in the upright position; FIG. 19B shows the hook 101 in the beginning phase of collapsing; and FIG. 19C shows the hook 101 in the fully collapsed position. As shown, in FIG. 19A, the hook 101 abuts the stop defined by the inner edge of the first side raised portion 640 and in FIG. 19C, the hook 101 abuts the stop defined by the second side raised portion 660.

FIGS. 20 and 21A and 21B show alternative constructions for the recessed portion for the first side wall and the axle drum. More specifically, the first side wall 620 can include a recessed portion 770 that has a petal like (gear) shape as opposed to the circular shape in the previous embodiment. The recessed portion 770 thus includes a circumferential formation of scalloped shaped notches 771. The scalloped shaped notches 771 are formed along the entire circumference. An axle drum 780 is shaped to be received and securely contained within the recessed portion 770 but as the same time, the axle drum 780 can rotate within the recessed portion 770. Thus, unlike the axle drum 670 that contains a discrete protrusion 672, the axle drum 780 includes a plurality of protrusions 782 that extend about the entire circumference of the axle drum 780. Axle drum 780 has a limited degree of rotation as in the previous embodiment but moves between the upright position and the collapsed position.

FIGS. 21A and 21B illustrate an alternative embodiment in which the outer face the first side wall 620 includes an outward protrusion 790 and is thus not flat and smooth as in the earlier illustrated embodiments. In other words, the recessed portion 630 (FIG. 12) extends through beyond the outer face of the first side wall 620 so as to form a bump out. When an outward protrusion 790 is formed in the first side wall 620 and the recessed portion (e.g., portion 630 or 770), the outward protrusion 790 can and preferably has a small footprint such that a landing 792 is formed between the scalloped shaped notches and the protrusion 790. The axle drum 780 (FIG. 20) seats against the landing 792. FIG. 21B shows the second side wall 700 also including protrusion 701 formed along the outer face thereof. Once again, the protrusion 701 is formed when the recessed portion 710 extends beyond the outer face of the second side wall 700.

The embodiment of FIGS. 11-21 can be implemented with any number of different hanger beam constructions, including but not limited to an I-beam construction as shown.

FIGS. 22-25 illustrates a collapsible hook receiving body 800 that is very similar to the hook receiving body 610 except that instead of being formed, at least partially, as an integral component of the hanger beam, the collapsible hook receiving body 800 can be pre-assembled and then coupled to a hanger beam 810. The hanger beam 810 includes a central portion 820 that is defined by a top edge 822. The top edge 822 is defined by a flat top wall 823 that includes at least one and preferably a plurality of openings (holes). The openings can be of the same type or, as shown, the openings can include two or more different types of openings. For example, the openings can include a first center opening 831 and a pair of side openings 833. The first center opening 831 can serve to locate the assembled hook receiving body 800 along the flat top wall 823. The pair of side openings 833 are formed on either side of the first center opening 831 and can serve as locking openings to actively lock the hook receiving body 800 in place along the flat top wall 823.

The hook receiving body 800 is formed of the second side wall 700 and a first side wall 900 that is very similar to the first side wall 620 and therefore, like elements are numbered alike. The main difference between the first side wall 900 and the first side wall 620 is that the first side wall 900 includes one or more locking fingers 910 that extend outwardly from a bottom of the first side wall 900. As shown in FIG. 22, the first side wall 900 includes a center locking post 920 that is received within the first center opening 831 and a pair of locking fingers 910 that are received within the locking openings 833. The center locking post 920 and the first center opening 831 are complementary and shape and in the illustrated embodiment, both have a circular footprint; however, they can be formed in any number of other shapes. The locking fingers 910 are configured to produce a locking between the first side wall 900 and the hanger beam 810. In one embodiment, the locking fingers 910 and the openings 833 are configured to form a mechanical attachment between the first side wall 900 and the hanger beam 810. For example, the distal ends of the locking fingers 910 can include locking detents 911 that lock with complementary structures formed as part of the hanger beam 810. The locking fingers 910 are flexible in nature after insertion into the openings 833, the continued force being applied to the first side wall 900 causes flexing of the fingers 910 to cause the locking detents 911 to move into locked positions.

In other words, a snap fit type of attachment can be formed between the first side wall 900 and the hanger beam 810.

It will be understood that the first side wall 900 can be first locked into place relative to the hanger beam 810 and then the axle drum 670 is inserted therein prior to attaching the second side wall 700 to the first side wall 900. The second side wall 700 and the first side wall 900 are attached to one another in the manner described hereinbefore. Alternatively, the axle drum 670 can be inserted into the first side wall 900 and then the second side wall 700 is attached to the first side wall 900 to form an assembly. The assembly is then attached to the hanger beam in its assembled form. It will be appreciated that the alternative constructions shown in FIGS. 20-21 can be implemented with the embodiment shown in FIGS. 22-25.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A collapsible hook hanger comprising:

a hook having a threaded end;

a hanger body including a cross bar having a top edge;

a hook receiving body extending from the top edge of the cross bar, the hook receiving body being defined by a first side wall and an opposing second side wall, wherein an inner surface of the second side wall includes a first recessed portion that is closed off by a portion of the second side wall that defines a rear wall of the first recessed portion, the first recessed portion being located opposite a second recessed portion formed in the first side wall and closed off by a portion of the first side wall that defines a rear wall of the second recessed portion, the hook receiving body having a hook receiving slot for receiving the hook; and an axle member having a first portion that is rotatably disposed within the first recessed portion of the first side wall; a threaded bore that is in communication with the hook receiving slot for receiving and mating to the threaded end of the hook; and a second portion that is rotatably received within the second recessed portion in the second side wall; wherein the axle member includes a locking feature that interlocks with the first side wall resulting in the axle member being rotatably captured within the hook receiving body;

wherein the hook is rotatable between a first upright position and a second folded position.

2. The collapsible hook hanger of claim 1, wherein the hook receiving slot is formed within one end wall and is open along a top of the hook receiving body.

3. The collapsible hook hanger of claim 1, wherein the first portion comprises a first face of the axle member and the second portion comprises a second face of the axle member and the locking feature comprises a protrusion that extends radially outward from a side wall of the axle member and is received within one of a plurality of shaped notches that surround the first recessed portion.

4. The collapsible hook hanger of claim 3, wherein the axle member comprises an arcuate shaped protrusion and the plurality of notches comprises a plurality of scalloped shaped notches formed within a first raised portion that surrounds the first recessed portion.

5. The collapsible hook hanger of claim 4, wherein an inner face of the first side wall includes a plurality of protrusions that are received within complementary bores formed in an inner face of the second side wall to couple the first and second side walls to one another, the first raised portion including a pair of bores that are adjacent the scalloped shaped notches.

6. The collapsible hook hanger of claim 1, wherein the first side wall comprises a first part and the second side wall comprises a second part, the first and second parts being configured to couple to one another with the axle member captured therebetween within the first and second recessed portions.

7. The collapsible hook hanger of claim 6, wherein the first side wall is integrally formed with the cross bar and the second side wall is attached to the first side wall by the snap-fit.

8. The collapsible hook hanger of claim 6, wherein an inner face of the second side wall includes a plurality of protrusions that are received within complementary bores formed in an inner face of the second side wall to couple the first and second side walls to one another.

9. The collapsible hook hanger of claim 8, wherein an inner face of the second side wall includes a plurality of protrusions that are received within complementary bores formed in an inner face of the second side wall to couple the first and second side walls to one another, the first and second side walls being coupled to one another by one of a snap-fit, an adhesive bond, and a weld.

10. The collapsible hook hanger of claim 6, wherein the first side wall includes at least one locking finger that extends outwardly from a bottom edge of the first side wall and is received within a corresponding locking hole formed in a top wall of the cross bar so as to snap-fittingly attach the first side wall to the cross bar.

11. The collapsible hook hanger of claim 10, wherein the top wall includes a first opening for receiving a locating post that extends outwardly from a bottom edge of the first side wall, wherein there are two or more locking fingers that snap-fittingly are received in corresponding locking holes.

12. The collapsible hook hanger of claim 1, wherein the axle member has a gear shape defined by a plurality of spaced protrusions and the first side wall includes a raised wall within a plurality of scalloped shaped notches that surround the first recessed portion.

13. The collapsible hook hanger of claim 1, wherein the first and second recessed portions are circular shaped and the axle member is cylindrical in shape.

14. A collapsible hook hanger comprising:

a hook having a threaded end;

a hanger body including a cross bar having a top edge;

a hook receiving body extending from the top edge of the cross bar, the hook receiving body being defined by a first side wall and an opposing second side wall, wherein an inner surface of the second side wall includes a first recess that is located opposite a second recess formed in the first side wall, the hook receiving body having a hook receiving slot for receiving the hook; and an axle member having a first portion that is rotatably disposed within the first recess of the first side wall; a threaded bore that is in communication with the hook receiving slot for receiving and mating to the threaded end of the hook; and a second portion that is rotatably received within the second recess in the second side wall; wherein the axle member includes a locking feature that interlocks with the first side wall resulting in the axle member being rotatably captured within the hook receiving body;

wherein the hook is rotatable between a first upright position and a second folded position;

wherein the first side wall comprises a first part and the second side wall comprises a second part, the first and second parts being configured to couple to one another with the axle member captured therebetween within the first and second recesses;

wherein the inner face of the first side wall includes a first raised portion that partially surrounds the first recess and a second raised portion adjacent the first recess and spaced from the first raised portion, the first raised portion including at least one bore and the second raised portion including at least one other bore, wherein an inner face of the second side wall includes a first rail that includes at least one protrusion and a second rail spaced from the first rail and including at least one other protrusion.

15. The collapsible hook hanger of claim 14, wherein the first raised portion includes a first groove that intersects the at least one bore and receives the first rail of the second side wall and the second raised portion includes a second groove that intersects the at least one other bore and receives the second rail of the second side wall.

16. The collapsible hook hanger of claim 14, wherein the first raised portion defines a first stop that defines a first end of travel of the hook and the second raised portion defines a second stop that defines a second end of travel of the hook.

17. The collapsible hook hanger of claim 14, wherein the first raised portion is formed opposite the hook receiving slot.

18. A collapsible hook hanger comprising:

a hook having a threaded end;

a hanger body including a cross bar having a top edge;

a hook receiving body extending from the top edge of the cross bar, the hook receiving body being defined by a first side wall and an opposing second side wall that is a separable from the first side wall, wherein an inner surface of the second side wall includes a first recessed portion that is located opposite a second recessed portion formed in the first side wall, the hook receiving body having a hook receiving slot for receiving the hook, wherein an inner face of the first side wall includes a plurality of bores formed therein and an inner face of the second side wall includes a plurality of protrusions that are received within the plurality of bores for attaching the first and second side walls to one another, wherein the first recessed portion includes a rear wall that closes off the first recessed portion and the second recessed portion includes a rear wall that closes off the second recessed portion; and an axle member having a first portion that is rotatably disposed within the first recessed portion of the first side wall; a threaded bore that is in communication with the hook receiving slot for receiving and mating to the threaded end of the hook; and a second portion that is rotatably received within the second recessed portion in the second side wall, wherein opposing ends of the axle member are disposed adjacent the rear walls of the respective first recessed portion and second recessed portion;

wherein the axle member includes a radially extending protrusion that is received within one of a plurality of notches formed circumferentially about the first recessed portion resulting in the axle member being rotatably captured within the hook receiving body;

wherein the hook is rotatable between a first upright position and a second folded position.

* * * * *